US007899374B2

(12) United States Patent
Abe et al.

(10) Patent No.: US 7,899,374 B2
(45) Date of Patent: Mar. 1, 2011

(54) MAGNETIC PARTICLE CARRYING DEVICE, AND DEVELOPING UNIT, PROCESS CARTRIDGE, AND IMAGE FORMING APPARATUS USING THE SAME, AND SURFACE TREATMENT METHOD OF THE SAME

(75) Inventors: Hiroya Abe, Yokohama (JP); Tsuyoshi Imamura, Sagamihara (JP); Kyohta Koetsuka, Fujisawa (JP); Tadaaki Hattori, Hatano (JP); Yoshiyuki Takano, Hachioji (JP); Noriyuki Kamiya, Yamato (JP); Masayuki Ohsawa, Atsugi (JP); Mieko Terashima, Isehara (JP); Takashi Innami, Atsugi (JP)

(73) Assignee: Ricoh Company, Ltd., Tokyo (JP)

( * ) Notice: Subject to any disclaimer, the term of this patent is extended or adjusted under 35 U.S.C. 154(b) by 617 days.

(21) Appl. No.: 12/013,143

(22) Filed: Jan. 11, 2008

(65) Prior Publication Data

US 2008/0170891 A1 Jul. 17, 2008

(30) Foreign Application Priority Data

Jan. 11, 2007 (JP) ..... 2007-003425
Apr. 24, 2007 (JP) ..... 2007-113883

(51) Int. Cl.
*G03G 15/09* (2006.01)

(52) U.S. Cl. ..... 399/276

(58) Field of Classification Search ..... 399/265, 399/267, 272, 276, 277, 286
See application file for complete search history.

(56) References Cited

U.S. PATENT DOCUMENTS 6,941,100 B2 * 9/2005 Yamada et al. ..... 399/279
2008/0008503 A1 1/2008 Imamura et al.

FOREIGN PATENT DOCUMENTS

| | | |
|---|---|---|
| JP | 04-191753 | 7/1992 |
| JP | 05-046007 | 2/1993 |
| JP | 07-013432 | 1/1995 |
| JP | 2000-321864 | 11/2000 |
| JP | 2002-268386 | 9/2002 |
| JP | 2005-164954 | 6/2005 |
| JP | 2007-086091 | 4/2007 |

* cited by examiner

*Primary Examiner* — David M Gray
*Assistant Examiner* — Gregory H Curran
(74) *Attorney, Agent, or Firm* — Oblon, Spivak, McClelland, Maier & Neustadt, L.L.P.

(57) ABSTRACT

A magnetic particle carrying device includes a magnetic field generator and a hollow cylindrical structure. The magnetic field generator generates a magnetic field. The hollow cylindrical structure encases the magnetic field generator and attracts magnetic particles on an external surface of the hollow structure using the magnetic field. The external surface of the hollow cylindrical structure is provided with a plurality of elliptical depressions. The depressions include first type depressions and second type depressions. A long axis of a first type of elliptical depression is substantially extending in an axial direction of the hollow cylindrical structure, and a long axis of a second type of elliptical depression is substantially extending in a circumferential direction of the hollow cylindrical structure. The external surface of the hollow cylindrical structure has more elliptical depressions of the second type than elliptical depressions of the first type.

7 Claims, 12 Drawing Sheets

MAGNETIC PARTICLE CARRYING DEVICE, AND DEVELOPING UNIT, PROCESS CARTRIDGE, AND IMAGE FORMING APPARATUS USING THE SAME, AND SURFACE TREATMENT METHOD OF THE SAME

CROSS-REFERENCE TO RELATED APPLICATIONS

This application claims priority from Japanese Patent Application Nos. 2007-003425, filed on Jan. 11, 2007, and 2007-113883, filed on Apr. 24, 2007 in the Japan Patent Office, the entire contents of each of which are hereby incorporated by reference herein.

BACKGROUND OF THE INVENTION

1. Field of the Invention

The present disclosure relates generally to a magnetic particle carrying device such as a developing agent carrier, a developing unit, a process cartridge, an image forming apparatus using the magnetic particle carrying device, and a surface treatment method for the magnetic particle carrying device.

2. Description of the Background Art

Typically, an image forming apparatus includes a photosensitive drum and a magnetic particle carrying device (e.g., a developing agent carrier) having a hollow structure (e.g., a developing sleeve). In such image forming apparatus, developing agent is carried on an external surface of the developing sleeve and then transported to the photosensitive drum for an image forming operation.

Such developing sleeve has an external surface subjected to a surface roughening process, for example sandblasting the external surface or forming grooves therein, so that the developing agent can be reliably carried on the developing sleeve.

Further, the developing sleeve has an external surface randomly formed with a number of depressions, each having a substantially elliptical shape when viewed from above. Such depressions in the developing sleeve are of two types, each defined by an orientation of a long axis of the elliptical depression. In a first type of depression, the long axis of the elliptical depression is substantially aligned with an axis of the developing sleeve, whereas in a second type of depression, the long axis of the depression is substantially aligned with a circumferential direction of the developing sleeve, that is, a direction perpendicular to the axial direction. The number of depressions of each type is typically unequal, with the first type predominant.

When a developing sleeve, having a hollow structure, is treated by the above-described sandblasting process to form concavities and convexities on its external surface, such concavities and convexities are relatively small. Accordingly, under repeated printing operations, such concavities and convexities are gradually scraped flat or nearly flat by the developing agent or the like, gradually reducing the amount of developing agent that the developing sleeve can transport and adversely affecting image quality, resulting, for example, in faint images.

The amount of developing agent that the developing sleeve can transport is enhanced by forming larger concavities and convexities on a surface of the developing sleeve, again by sandblasting. However, such an approach has drawbacks. For example, the more powerful sandblasting that is required to form larger concavities and convexities can deform the developing sleeve itself, adversely affecting its rotation. Failure of the developing sleeve to rotate precisely can cause a predetermined gap set between the developing sleeve and the photosensitive drum to fluctuate, which may result in an unstable supply of the developing agent to the photosensitive drum and a consequent lack of appropriate toner concentration in the formed image.

Alternatively, as described above, grooves can be formed in the external surface of the developing sleeve. Such grooves can be larger than the concavities and convexities formed by the above-described sandblasting process, and larger also than the particles of magnetic carrier or the like contained in a developing agent. This larger size of the grooves prevents them from being as thoroughly or as rapidly abraded by the developing agent as the concavities formed by sandblasting tend to be, and therefore the amount of developing agent that can be transported by the developing sleeve does not deteriorate as greatly over time.

However, such developing sleeve may have an uneven distribution of developing agent across its external surface because the grooves can carry and transport greater amounts of developing agent than areas having no grooves, which may lead to uneven toner concentration in the resultantly produced images.

With respect to the above-described elliptical depressions formed in the external surface of the developing sleeve, these are larger or deeper than dents formed by conventional sandblasting. Therefore, the developing agent is less likely to abrade such elliptical depressions, and therefore the amount of developing agent that the developing sleeve can carry does not deteriorate over time and images having appropriate concentrations of toner can continue to be produced.

Further, because such depressions can be formed on the external surface of the developing sleeve randomly, the developing agent can be carried on the developing sleeve randomly as a whole, which means that the developing agent can be uniformly attracted to the developing sleeve as a whole. Therefore, such developing sleeve may suppress image concentration unevenness of resultantly produced images.

Further, as noted above, the depressions on the external surface of the developing sleeve include first type depressions, extending in the axial direction of the developing sleeve, and the second type depressions, extending in the circumferential direction of the developing sleeve, and the number of the first type depressions is greater than the number of the second type depressions on the external surface. Accordingly, the developing agent can be picked-up onto the developing sleeve along the axial direction of the developing sleeve. Therefore, even if the developing sleeve rotates, the picked-up developing agent is less likely to drop from the external surface of the developing sleeve. Accordingly, elliptical depressions may be able to carry as much developing agent as the above-described grooves do.

However, such depressions in the developing sleeve may include a relatively smaller number of depressions aligned in the circumferential direction of the developing sleeve. Accordingly, adhering density (or amount) of developing agent in the circumferential direction of the developing sleeve may become lower or uneven, and thereby image concentration unevenness in a sheet transport direction may not be effectively suppressed or prevented. In general, image concentration unevenness in a sheet transport direction is more recognizable compared to image concentration unevenness in a sheet width direction, which is perpendicular to the sheet transport direction.

In view of such background, a method or an apparatus capable of suppressing image concentration unevenness in a sheet transport direction is desired.

SUMMARY

The present invention provides a magnetic particle carrying device including a magnetic field generator and a hollow cylindrical structure. The magnetic field generator generates a magnetic field. The hollow cylindrical structure encases the magnetic field generator and attracts magnetic particles on an external surface of the hollow structure using the magnetic field. The external surface of the hollow cylindrical structure is provided with a plurality of elliptical depressions. The depressions include first type depressions and second type depressions. A long axis of a first type of elliptical depression is substantially extending in an axial direction of the hollow cylindrical structure, and a long axis of a second type of elliptical depression is substantially extending in a circumferential direction of the hollow cylindrical structure. The external surface of the hollow cylindrical structure has more elliptical depressions of the second type than elliptical depressions of the first type.

The present invention also provides an image forming apparatus including a latent image carrier, a charger, a writer, and a developing unit. The latent image carrier carries a latent image thereon. The charger charges a surface of the latent image carrier. The writer configured to write the latent image on the latent image carrier. The developing unit develops the latent image with a developing agent using a magnetic particle carrying device. The magnetic particle carrying device includes a magnetic field generator and a hollow cylindrical structure. The magnetic field generator generates a magnetic field. The hollow cylindrical structure encases the magnetic field generator and attracts magnetic particles on an external surface of the hollow structure using the magnetic field. The external surface of the hollow cylindrical structure is provided with a plurality of elliptical depressions. The depressions include first type depressions and second type depressions. A long axis of a first type of elliptical depression is substantially extending in an axial direction of the hollow cylindrical structure, and a long axis of a second type of elliptical depression is substantially extending in a circumferential direction of the hollow cylindrical structure. The external surface of the hollow cylindrical structure has more elliptical depressions of the second type than elliptical depressions of the first type.

The present invention also provides a method of roughening a surface of an object. The method includes generating and impacting. The generating step generates a rotated magnetic field around the object. The impacting step impacts a plurality of cylindrically shaped abrasive grains against an external surface of the object with an effect of the rotated magnetic field having a frequency of 200 Hz to 400 Hz.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
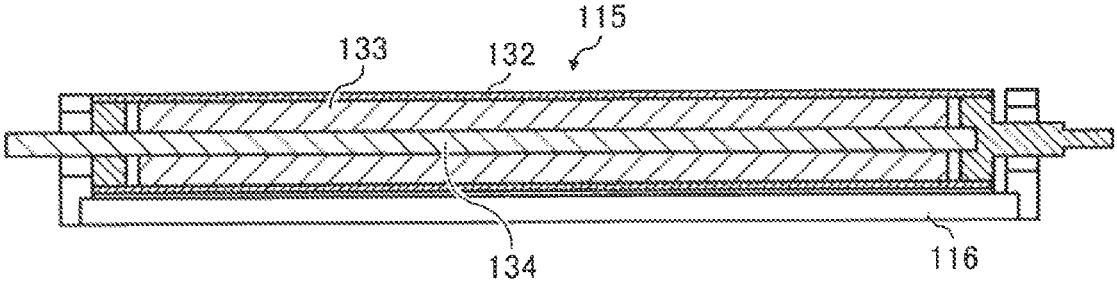
FIG. 1 illustrates a cross-sectional view of a magnetic particle carrying device according to an exemplary embodiment.

The accompanying drawings are intended to depict exemplary embodiments of the present invention and should not be interpreted to limit the scope thereof. The accompanying drawings are not to be considered as drawn to scale unless explicitly noted, and identical or similar reference numerals designate identical or similar components throughout the several views.

DETAILED DESCRIPTION OF EXEMPLARY EMBODIMENTS

A description is now given of exemplary embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of the present invention.

In addition, it should be noted that the terminology used herein is for the purpose of describing particular embodiments only and is not intended to be limiting of the present invention. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Furthermore, although in describing exemplary embodiments shown in the drawings, specific terminology is employed for the sake of clarity, the present disclosure is not limited to the specific terminology so selected and it is to be understood that each specific element includes all technical equivalents that operate in a similar manner.

Referring now to the drawings, a magnetic particle carrying device (e.g., developing sleeve) according to an exemplary embodiment is described with reference to accompanying drawings.

A description is now given to a magnetic particle carrying device according to an exemplary embodiment with reference mainly to FIGS. 1 to 6, 10, and 18.

As illustrated in FIG. 1, a developing roller 115, used as magnetic particle carrying device, includes a cored bar 134, a magnet roller 133, and a developing sleeve 132, for example. The cored bar 134 is disposed so that its longitudinal direction is parallel to the longitudinal direction of a photosensitive drum 108 (see FIG. 10), and is fixed to a casing 125 of a development unit 113 shown in FIG. 10 in an unrotatable manner.

The magnet roller 133, used as magnetic field generator, may be made of a magnetic material and shaped in a cylindrical shape. The magnet roller 133 is attached with a plurality of fixed magnetic poles (not shown). The magnet roller 133 is fixed to an outer circumference of the cored bar 134, and thereby is not allowed to rotate about the axial center of the cored bar 134.

Each of the fixed magnetic poles may be a magnet having a long bar-like shape, and is attached to the magnet roller 133. The fixed magnetic pole extending along the longitudinal direction of the magnet roller 133 (i.e., the developing roller 115) is provided throughout the length of the magnet roller 133. Such configured magnet roller 133 is encased in the developing sleeve 132, which has a hollow structure having a cylindrical shape, for example.

As later described with reference to FIG. 10, one of the fixed magnetic poles faces a stirring screw 118, and used as a pick-up magnetic pole for picking up developing agent to the developing sleeve 132 of the developing roller 115. As also later described with reference to FIG. 10, another fixed magnetic pole faces the photosensitive drum 108, and used as development magnetic pole. The development magnetic pole forms a magnetic field between the developing roller 115 and the photosensitive drum 108.

The fixed magnetic poles may be used to attract a magnetic carrier 135 (see FIG. 9), made of magnetic particle and included in developing agent 126 (see FIG. 8), to an external surface of the developing sleeve 132. The magnetic carrier 135 may be stacked one on the other along a magnetic field generated by the fixed magnetic poles, by which a aggregated chain of the magnetic carrier 135 may be formed on the external surface of the developing sleeve 132 in a protruding manner (see FIGS. 7 and 8). The term of "magnetic carrier" may be used in this disclosure while having a meaning of singular or plural magnetic particles. Accordingly, the magnetic carrier 135 or the magnetic carrier 135 may be used in this disclosure.

Then, toner particles included in the developing agent 126 may be attracted to the protruded aggregated chain of the magnetic carrier 135. Accordingly, the developing agent 126 is attracted to on the external surface of the developing sleeve 132 with an effect of magnetic force of the magnet roller 133.

Figure 2:
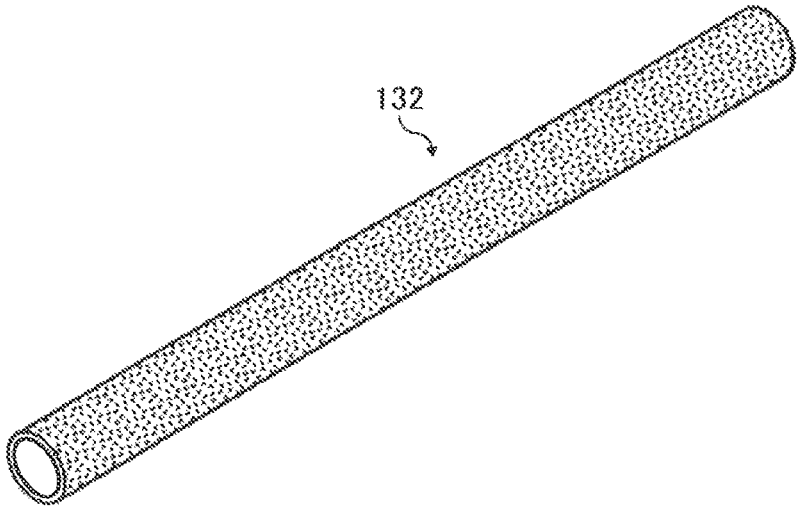
FIG. 2 illustrates a perspective view of a hollow structure of the magnetic particle carrying device of FIG. 1.
Figure 3:
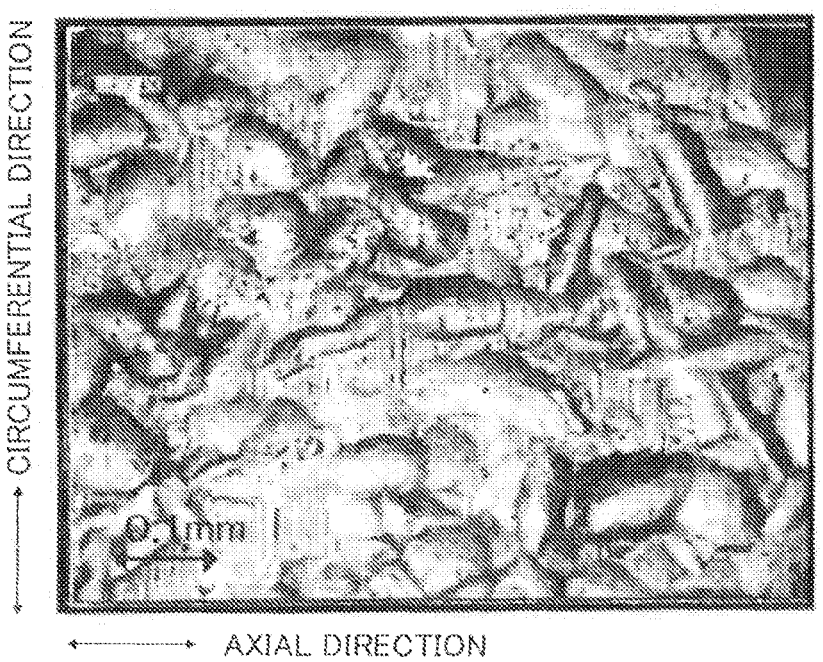
FIG. 3 is an expanded surface-pictured view of a hollow structure of the magnetic particle carrying device of FIG. 1, in which depressions, having elliptical shape, include first depressions aligned in the axial direction of the hollow structure and second depressions aligned in the circumferential direction of the hollow structure, wherein the first depressions are greater in numbers compared to the second depressions.
Figure 4:
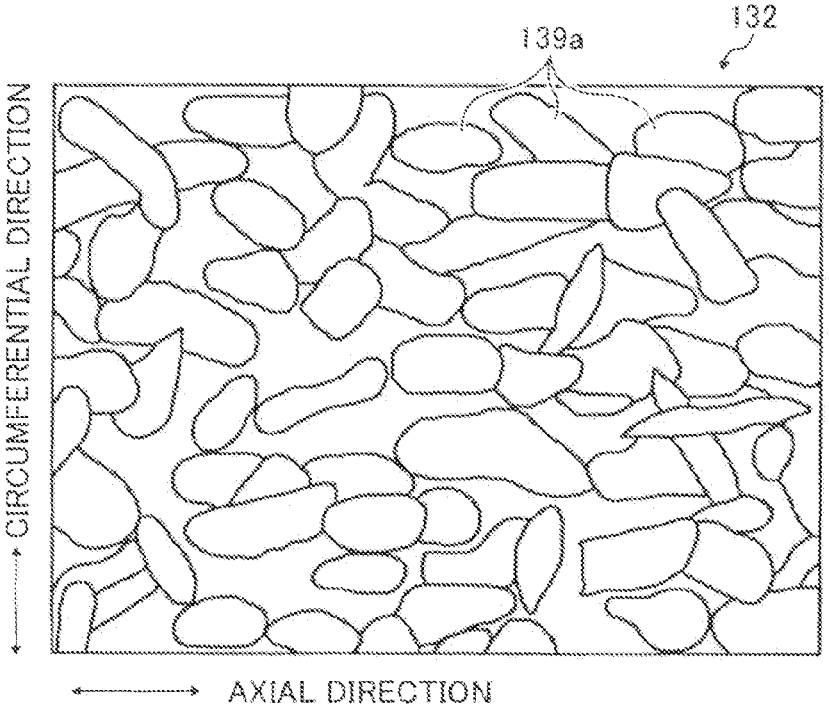
FIG. 4 illustrates a schematic view of an external surface of the hollow structure of FIG. 3.
Figure 5:
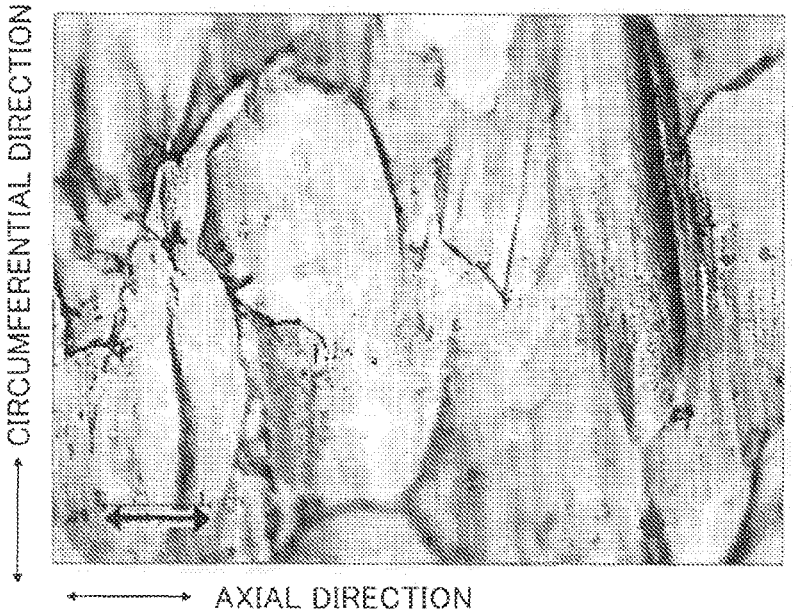
FIG. 5 is an expanded surface-pictured view of a hollow structure of the magnetic particle carrying device of FIG. 1, in which depressions having elliptical shape include first depressions aligned in the axial direction of the hollow structure and second depressions aligned in the circumferential direction of the hollow structure, wherein the second depressions are greater in numbers compared to the first depressions.
Figure 6:
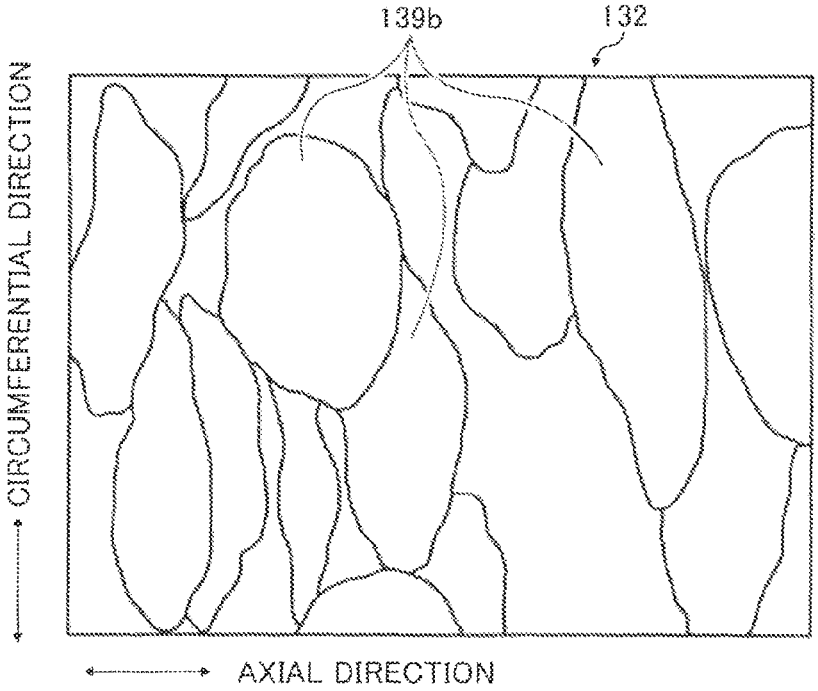
FIG. 6 illustrates a schematic view of an external surface of the hollow structure of FIG. 5.

As illustrated in FIG. 2, the developing sleeve 132 has a cylindrical shape, for example. The developing sleeve 132 encases the magnet roller 133 therein, and can rotate about the axial center of the developing sleeve 132. Accordingly, the inner surface of the developing sleeve 132 may sequentially faces each of the fixed magnetic poles when the developing sleeve 132 rotates about its axis. The developing sleeve 132 may be made of a non-magnetic material such as aluminum alloy, stainless steel (SUS), or the like, for example. As described later, the external surface of the developing sleeve 132 may be treated by a surface treatment machine 1 (see FIG. 12) to make the external surface as preferably roughened surface.

As a base material of the developing sleeve 132, aluminum alloy may be preferably used from a viewpoint of its machinability and lightweight. When aluminum alloy is used as base material of the developing sleeve 132, aluminum alloy having standard of A6063, A5056, or A3003 may be preferably used, for example. When SUS (stainless steel) is used, SUS 303, SUS 304, or SUS 316 may be preferably used, for example.

The developing sleeve 132 may have a given outer diameter such as 17 mm to 18 mm and a given axial length such as 240 mm to 350 mm, for example. The size of the developing sleeve 132 may be changed to any values depending on a design concept or the like. The external surface of the developing sleeve 132 has a given surface roughness, which may vary depending on a surface portion of the developing sleeve 132. For example, a depth of depressions formed on the developing sleeve 132 may become gradually deeper in an axial direction, which starts from a center portion to an each end portion of the developing sleeve 132.

Further, as illustrated FIGS. 3 to 6, the external surface of the developing sleeve 132 has a number of depressions 139 having elliptical shape when viewed from above the developing sleeve 132. As illustrated FIGS. 3 to 6, such depressions 139 are randomly formed on the external surface of the developing sleeve 132. As illustrated FIG. 3 to 6, the depressions 139 may have two types of depressions, that is, first depressions 139*a* (see FIGS. 3 and 4) and second depressions 139*b* (see FIGS. 5 and 6).

In the first depressions 139*a*, a long axis of elliptical shape may be substantially aligned in an axial direction of the developing sleeve 132. For example, the long axis of elliptical shape of the first depressions 139*a* may have an angle of within ±45 degrees with respect to the axial direction of the developing sleeve 132.

In the second depressions 139*b*, a long axis of elliptical shape may be substantially aligned in a circumferential direction of the developing sleeve 132. For example, the long axis of elliptical shape of the second depressions 139*b* may have an angle of within ±45 degrees with respect to the circumferential direction of the developing sleeve 132, wherein the circumferential direction of the developing sleeve 132 is a rotation direction of the developing sleeve 132 in this disclosure. In an exemplary embodiment, the developing sleeve 132 may have a greater number of the second depressions 139*b* compared to the first depressions 139*a*, for example. Further, the depressions 139 having elliptical shape may have a given major axis length of such as 0.05 mm to 2 mm, and a given minor axis length of such as 0.02 mm to 1 mm, for example. As illustrated in FIG. 3 to FIG. 6, the axial direction and the circumferential direction of the developing sleeve 132 are perpendicular with each other.

Figure 18:
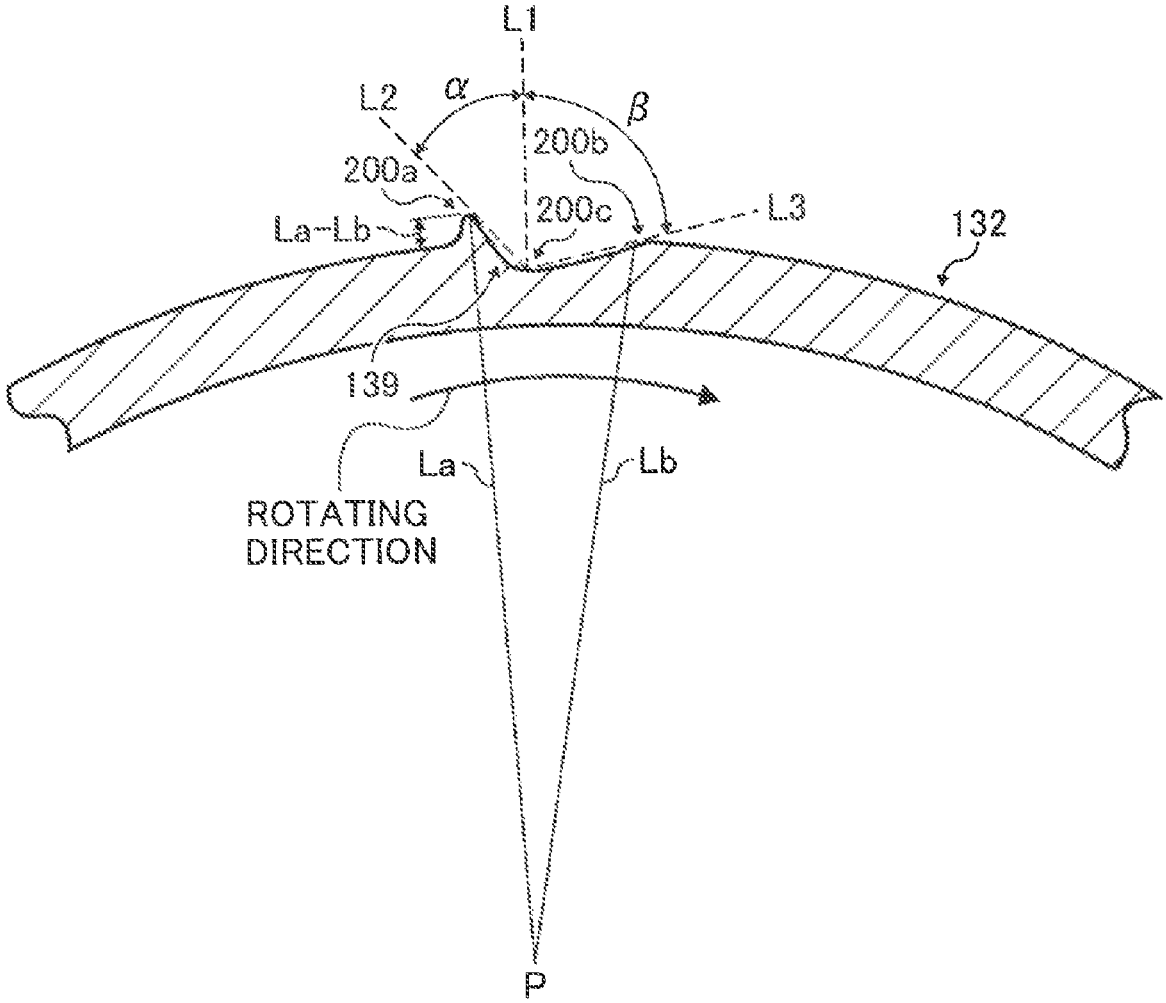
FIG. 18 illustrates a cross-sectional view of a depression having elliptical shape and aligned in a circumferential direction of a hollow structure.

Further, as illustrated in FIG. 18, the depression 139 may have a peripheral end portion 200*a* (i.e., rear edge of depression 139), which may be protruded from an external face of the developing sleeve 132, and a deepest portion 200*c* (i.e., bottom of depression 139), from which a hypothetical first line L1 and a hypothetical second line L2 are extended. The hypothetical first line L1 may outwardly extend from the deepest portion 200*c* of the depression 139 in a radial direction of the developing sleeve 132. The hypothetical second line L2 may outwardly extend from the deepest portion 200*c* to the peripheral end portion 200*a* of the depression 139, wherein the peripheral end portion 200*a* is a rearward position of the depression 139 with respect to a direction of rotation (shown by an arrow in FIG. 18) of the developing sleeve 132 when magnetic particles are attracted on the developing sleeve 132. As illustrated in FIG. 18, the hypothetical first and second lines L1 and L2 may form an angle $\alpha$. In an exemplary embodiment, average or mean value of the angle $\alpha$ is preferably set within 45 degrees. If the angle $\alpha$ is set within 45 degrees, the deepest portion 200*c* may come to a position closer to the peripheral end portion 200*a* of the depression 139.

Further, as also illustrated in FIG. 18, the depressions 139 may have a hypothetical straight-line segment La and a radius segment Lb. The hypothetical straight-line segment La extends from a rotation center P of the developing sleeve 132 to the peripheral end portion 200*a* of the depression 139. The radius segment Lb is one half of an outer diameter of the developing sleeve 132. In an exemplary embodiment, the hypothetical straight-line segment La may be set greater than the radius segment Lb, and preferably, the hypothetical straight-line segment La and the radius segment Lb may have a relationship of "20 μm≧La−Lb>5 μm" as described later. When such relationship is set, the peripheral end portion 200*a* may be preferably protruded from the external surface of the developing sleeve 132.

A description is now given to a process of attracting the developing agent 126 to the external surface of the developing roller 115.

Figure 10:
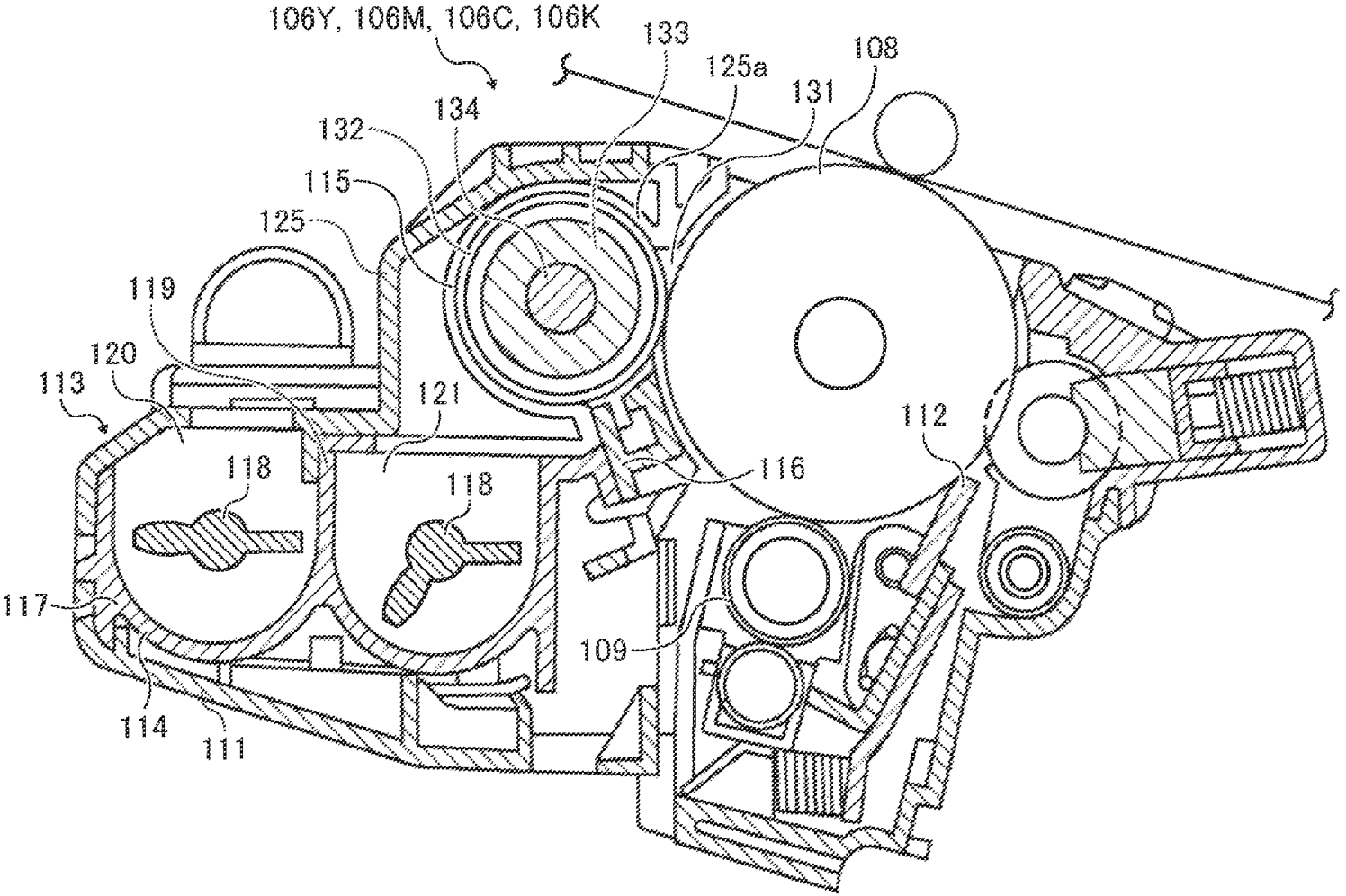
FIG. 10 illustrates a cross-sectional view of a developing unit, and a process cartridge according to an exemplary embodiment.

As illustrated in FIG. 10, in the development unit 113, the developing roller 115 and the developing agent 126 face each other with a given gap therebetween, wherein the developing roller 115 is used as developing agent carrier, and the developing agent 126 includes the magnetic carrier 135 used as magnetic particles and toner particles.

As above described, the developing roller 115 encases the magnet roller 133 attached with the above-described pick-up magnetic pole. As above described, the pick-up magnetic pole generates a magnetic force over the external surface of the developing sleeve 132 (or developing roller 115). With an effect of such magnetic force, the developing agent 126 in a second compartment 121 of a container 117 (see FIG. 10) may be attracted on the external surface of the developing sleeve 132.

Further, the above-described development magnetic pole generates a magnetic force over the external surface of the developing sleeve 132 (or developing roller 115). With an effect of such magnetic force, the development magnetic pole forms a magnetic field between the developing sleeve 132 and the photosensitive drum 108. The development magnetic pole may be used to form magnetic brushes of the magnetic carriers 135 with an effect of the magnetic field so that the developing agent 126 is attracted on the external surface of the developing sleeve 132 and then transferred from the developing roller 115 to the photosensitive drum 108 via the magnetic brushes.

Further, at least one fixed magnetic pole may be provided between the pick-up magnetic pole and the development magnetic pole. Such at least one fixed magnetic pole generates a magnetic force over the external surface of the developing sleeve 132 (or developing roller 115) so that the developing agent 126, to be used for a developing process, can be transported to a position facing the photosensitive drum 108, or such magnetic force generated by such at least one fixed magnetic pole is used to transport the developing agent 126, already used by a developing process, from the photosensitive drum 108 to the container 117.

Figure 7:
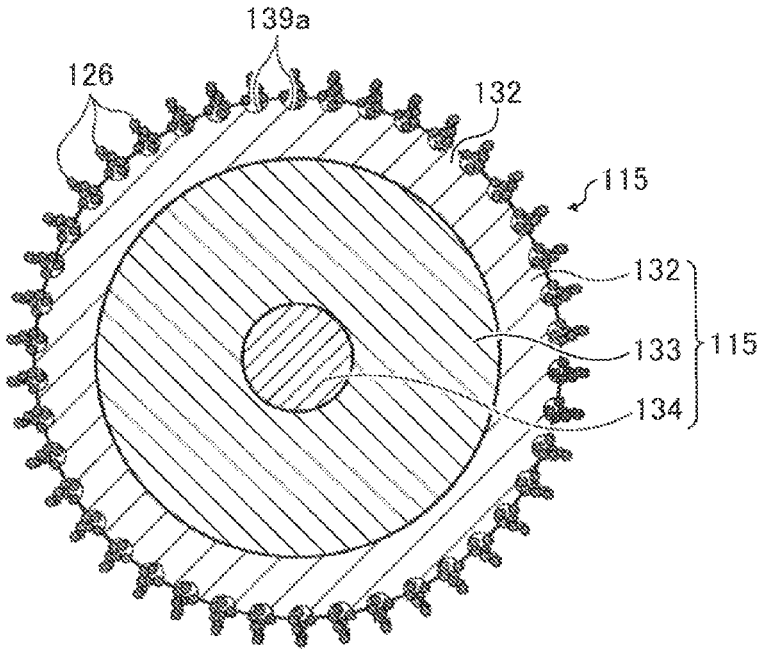
FIG. 7 illustrates a cross-sectional view of the magnetic particle carrying device using the hollow structure of FIG. 3, in which protruded aggregated chains of developing agent are formed on the external surface of the magnetic particle carrying device.
Figure 8:
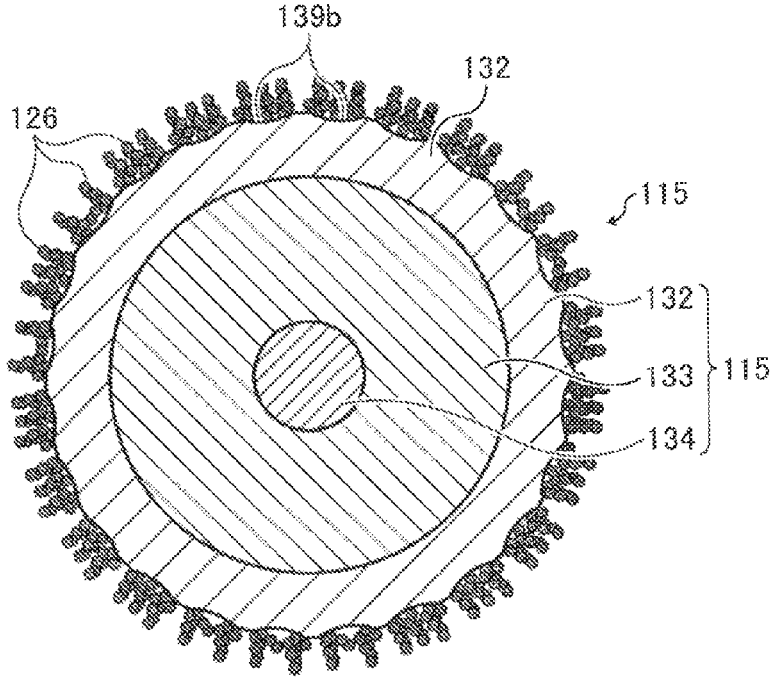
FIG. 8 illustrates another cross-sectional view of the magnetic particle carrying device using the hollow structure of FIG. 5, in which protruded aggregated chains of developing agent are formed on the external surface of the magnetic particle carrying device.

A description is now given to a protruded aggregated chain of the developing agent 126 formed on the developing sleeve 132 with reference to FIGS. 7 and 8. Specifically, protruded aggregated chain of the developing agent 126 may be formed in a different manner between the first depressions 139*a* and the second depressions 139*b*. As described above, the first depressions 139*a* may have elliptical shape, extending along the axial direction of the developing sleeve 132, and the second depressions 139*b* may have elliptical shape, extending along the circumferential direction of the developing sleeve 132.

FIG. 7 illustrates one state of a cross-sectional view of the developing roller 115 having protruded aggregated chains of the developing agent 126, in which the number of the first depressions 139*a* is greater than that of the second depressions 139*b*. FIG. 8 illustrates another state of a cross-sectional view of the developing roller 115 having protruded aggregated chains of the developing agent 126, in which the number of the second depressions 139*b* is greater than that of the first depressions 139*a*.

As shown in FIGS. 7 and 8, an effective length of depressions 139, which can carry or hold the developing agent 126, is different between the two states shown in FIG. 7 or 8. Specifically, the effective length of depressions 139 along the circumferential direction of the developing roller 115 (used as magnetic particle carrying device) in FIG. 8 becomes greater than that in FIG. 7, wherein the developing roller 115 has a greater number of the first depressions 139*a* in FIG. 7 and a greater number of the second depressions 139*b* in FIG. 8 as described above.

Because the developing agent 126 is closely attracted in the depressions 139 of the developing sleeve 132, an adhering density of the developing agent 126 in the circumferential direction of the developing sleeve 132 becomes greater in case of FIG. 8. Further, protruded aggregated chains of the developing agent 126 may be formed in each of the second depressions 139*b* more uniformly.

As above described, in an exemplary embodiment, the external surface of the developing sleeve 132 may include the number of depressions 139 having elliptical shape, wherein the depressions 139 may include a greater number of the second depressions 139*b* compared to the first depressions 139*a*. Accordingly, magnetic particles included in the developing agent 126 may be uniformly attracted on the external surface of the developing sleeve 132 in the circumferential direction of the developing sleeve 132. Further, such magnetic particles may be attracted on the external surface of the developing sleeve 132 with a greater density in the circumferential direction of the developing sleeve 132 as above described.

Therefore, the developing roller 115 can supply the developing agent 126 to a circumferential direction of the photosensitive drum 108 more uniformly. In other words, the developing agent 126 can be supplied to a direction of rotation of the photosensitive drum 108 more uniformly, wherein the direction of rotation of the photosensitive drum 108 is aligned to a transport direction of a transfer member such as sheet, intermediate transfer belt or the like. Accordingly, a toner image can be developed on the photosensitive drum 108 by decreasing unevenness of image concentration, by which an image having higher quality can be produced on a transfer member.

Further, the depressions 139 having elliptical shape, formed on the external surface of the developing sleeve 132, may have a greater size compared to dents formed by a conventional sandblasting process, wherein the depression 139 may have a major axis length of 0.05 mm to 2 mm, and a minor axis length of 0.02 mm to 1 mm, for example. Therefore, compared to the conventional sandblasting process, the developing agent 126 is less likely to abrade such elliptical depressions of the depressions 139, and therefore the amount of developing agent 126 that the developing sleeve 132 can carry does not deteriorate over time and images having appropriate concentrations of toner can continue to be produced. The amount of developing agent 126 that the developing sleeve 132 can carry may be referred as transportability (or transport amount) of the developing agent 126 by the developing sleeve 132.

Further, as above described with reference to FIG. 18, the depressions 139 on the external surface of the developing sleeve 132 includes the deepest portion 200*c* and the peripheral end portion 200*a*, wherein the deepest portion 200*c* is closer to the peripheral end portion 200*a* positioning at a rearward position of the depression 139 with respect to the direction of rotation of the developing sleeve 132.

In an exemplary embodiment, as above described, the hypothetical first line L1 extending outwardly from the deepest portion 200*c* in a radial direction of the developing sleeve 132 and the second line L2 extending outwardly from the deepest portion 200*c* to the peripheral end portion 200*a* of the depression 139 may form the angle $\alpha$ within 45 degrees.

Accordingly, the depressions 139 may scoop up magnetic particles when the developing agent 126 is carried up to the developing sleeve 132 from the second compartment 121 (see FIG. 10), and the depressions 139 may reliably carry or hold the magnetic carriers 135 therein. Therefore, the magnetic carriers 135 may be held on the external surface of the developing sleeve 132 more reliably, by which the developing agent 126 may also be held on the external surface of the developing sleeve 132 more reliably. Therefore, the amount of developing agent 126 that the developing sleeve 132 can carry does not deteriorate over time and images having appropriate concentrations of toner can continue to be produced.

Further, a depth of the depression 139 may be set to a relatively smaller value in an exemplary embodiment while maintaining a good level of holding capability of developing agent 126, by which processing energy (e.g., mechanical force) applied for forming the depressions 139 on the external surface of the developing sleeve 132 can be set smaller, which may be preferable for suppressing a shape deformation of the developing sleeve 132 (e.g., misaligned axis, change of inner/outer diameter, collapsing of sleeve shape). Accordingly, the developing sleeve 132 can be manufactured with a higher precision, and can rotate with a higher precision, by which an image having higher quality can be produced with a good level of toner concentration.

Further, the depression 139 on the external surface of the developing sleeve 132 may have the peripheral end portion 200*a* at a rearward position with respect to the direction of rotation of the developing sleeve 132, wherein the peripheral end portion 200*a* may protrude from the external surface of the developing sleeve 132. Accordingly, an area extending from the deepest portion 200*c* to the peripheral end portion 200*a* in the depression 139 may become relatively greater in size, by which the magnetic carriers 135 can be carried or held on the external surface of the developing sleeve 132 more reliably, by which the developing agent 126 may also be carried or held on the external surface of the developing sleeve 132 more reliably. Therefore, the amount of developing agent 126 that the developing sleeve 132 can carry does not deteriorate over time and images having appropriate concentrations of toner can continue to be produced.

Further, because the depressions 139 may be randomly formed on the external surface of the developing sleeve 132, the developing agent 126 may randomly be attracted on the external surface of the developing sleeve 132, by which the developing agent 126 may be uniformly attracted on the external surface of the developing sleeve 132 as a whole. Accordingly, the developing agent 126 can be uniformly transported on the developing sleeve 132, by which the developing agent 126 can be uniformly supplied to the photosensitive drum 108 from the developing agent 126, by which an image having higher quality can be produced with a good level of toner concentration.

A description is now given to the development unit 113, which employs the above-described developing roller 115, with reference to FIG. 10. As illustrated in FIG. 10, the development unit 113 may include an agent supply compartment 114, a casing 125, the developing roller 115, and a doctor blade 116, for example.

The agent supply compartment 114 may include the container 117, and a pair of stirring screws 118 for agitating the developing agent 126. The container 117 may have a length, substantially matched to a length of the photosensitive drum 108. Further, the container 117 is provided with a separation wall 119, extending in a longitudinal direction of the container 117. The separation wall 119 separates the container 117 into a first compartment 120 and a second compartment 121. Further, the first and second compartments 120 and 121 are communicated with each other at their both end portions.

In the container 117, the developing agent 126 is contained in the first and second compartments 120 and 121. The developing agent 126 may include toner particles and the magnetic carrier 135 made of magnetic particles (see FIG. 9). Fresh toner particles may be supplied to one end portion of the first compartment 120, which may be far from the developing roller 115, for example, in a timely manner. Toner particles may be fine spherical particles, prepared by an emulsion polymerization method or a suspension polymerization method, for example. Toner particles may also be prepared by a pulverization method, in which synthetic resin mixed and dispersed with dyes or pigments may be pulverized. Toner particles may have an average particle diameter of 3 μm to 7 μm, for example.

The stirring screw 118, provided for the first and second compartments 120 and 121, respectively, has a longitudinal direction parallel to longitudinal directions of the container 117, the developing roller 115, and the photosensitive drum 108. The stirring screw 118, which is rotatable about its axial center, agitates toner particles and the magnetic carriers 135, and transports the developing agent 126. Further, the stirring screw 118 in the first compartment 120 transports the developing agent 126 from the one end portion to other end portion, and the stirring screw 118 in the second compartment 121 transports the developing agent 126 from the other end portion to the one end portion.

In the agent supply compartment 114, toner particles supplied to the one end portion of the first compartment 120 are transported to the other end portion of the first compartment 120 while agitated with the magnetic carriers 135, and the agitated toner particles and the magnetic carriers 135 are transported to the second compartment 121 from the other end portion of the first compartment 120. Then, in the agent supply compartment 114, toner particles and the magnetic carriers 135 are agitatingly transported in the second compartment 121, and supplied to the external surface of the developing roller 115.

The casing 125, attached to the container 117 of the agent supply compartment 114, may encase the developing roller 115 or the like with the container 117. Further, the casing 125 has an opening 125, facing the photosensitive drum 108.

The developing roller 115, formed into a cylindrical shape, is provided between the second compartment 121 and the photosensitive drum 108, and adjacent to the opening 125*a*. The developing roller 115 is disposed parallel to the photosensitive drum 108 and the container 117. The developing roller 115 faces the photosensitive drum 108 with a given gap therebetween. The developing roller 115 and the photosensitive drum 108 form the developing area 131 at such gap portion, at which toner particles in the developing agent 126 are transferred and adhered to the photosensitive drum 108 to develop an electrostatic latent image formed on the photosensitive drum 108 as toner image.

The doctor blade 116, attached to the casing 125, is disposed over the external surface of the developing sleeve 132 with a given gap, and may be disposed adjacent to the photosensitive drum 108 in the development unit 113. The doctor blade 116 scrapes the developing agent 126, supplied on the external surface of the developing sleeve 132, to control an amount of the developing agent 126 at a given level, by which a given amount of developing agent 126 can be reliably transported to the developing area 131.

The developing agent 126 may be transported to the developing area 131 in the development unit 113 as follows.

In the development unit 113, toner particles and the magnetic carrier 135 are agitated in the agent supply compartment 114, and the agitated developing agent 126 is then attracted on the external surface of the developing sleeve 132 with an effect of the fixed magnetic poles in the developing roller 115. With a rotation of the developing sleeve 132, such attracted developing agent 126 is transported to the developing area 131. After controlling a thickness of the developing agent 126 with the doctor blade 116, the developing agent 126 is adhered onto the photosensitive drum 108. With such processes, an electrostatic latent image on the photosensitive drum 108 is developed with the developing agent 126 as toner image. After such developing process, the developing agent 126 remaining on the developing roller 115 are removed and recovered into the container 117. Such recovered developing agent 126 is then agitated with the developing agent 126 in the second compartment 121, and further used as developing agent for developing another electrostatic latent image on the photosensitive drum 108.

In an exemplary embodiment, the development unit 113 employs the developing roller 115 as magnetic particle carrying device, which can supply the developing agent 126 to a circumferential direction of the photosensitive drum 108 more uniformly. In other words, the developing agent 126 can be supplied to a direction of rotation of the photosensitive drum 108 more uniformly, wherein the direction of rotation of the photosensitive drum 108 is aligned to a transport direction of a transfer member such as sheet, intermediate transfer belt or the like. Accordingly, a toner image can be developed on the photosensitive drum 108 by decreasing unevenness of image concentration, by which an image having higher quality can be produced on a transfer member.

Figure 9:
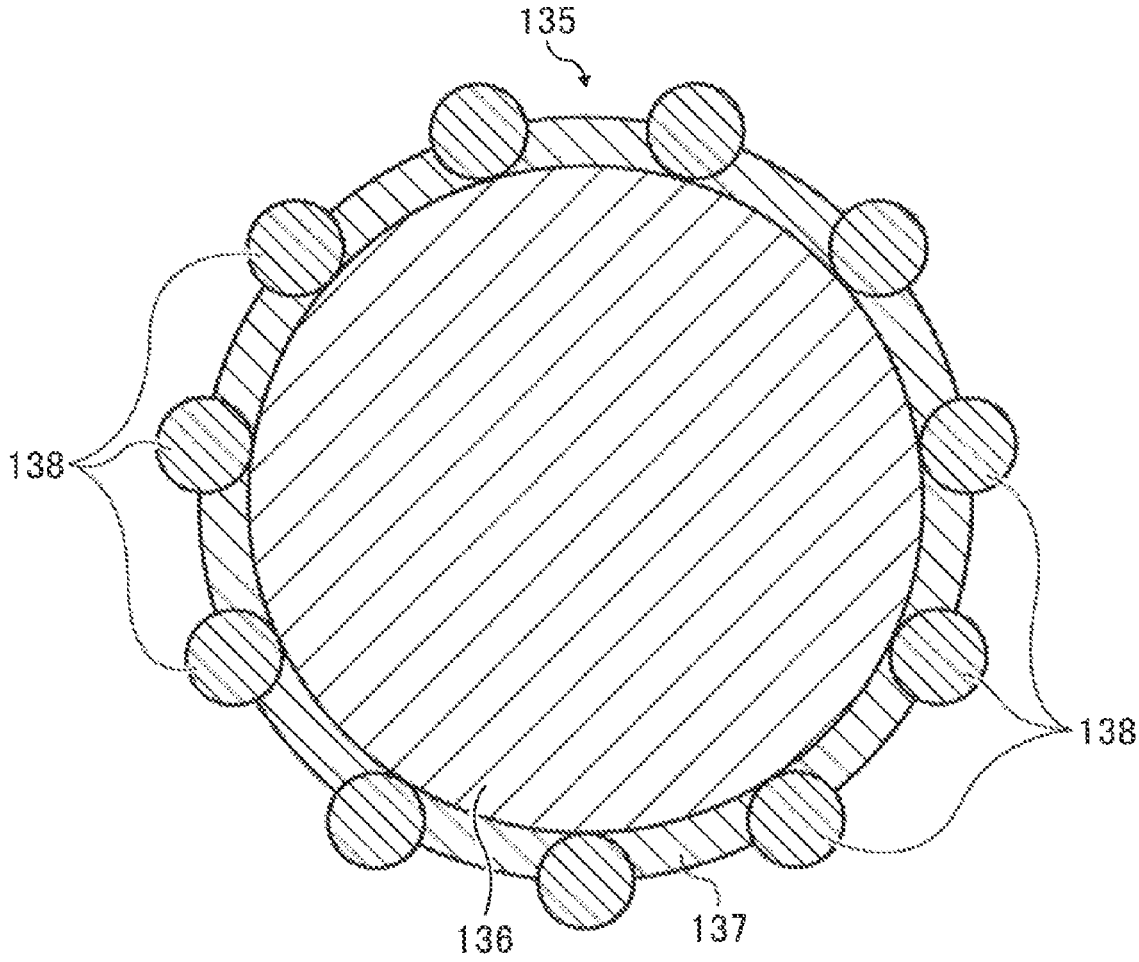
FIG. 9 illustrates a cross-sectional view of a magnetic particle used for a developing agent.

A description is now given to the magnetic carrier 135 with reference to FIG. 9. As above described, the magnetic carrier 135 is contained in the first and second compartments 120 and 121. The magnetic carrier 135 may have an average particle diameter of 20 μm to 50 μm, for example. As illustrated in FIG. 9, the magnetic carrier 135 may include a core 136, a resin coat layer 137, and alumina particles 138, for example. An external surface of the core 136 is coated with the resin coat layer 137, and the alumina particles 138 are dispersed in the resin coat layer 137.

If the magnetic carrier 135 may have too small average particle diameter (e.g., less than 20 μm), the magnetic carrier 135 may have smaller magnetic force, which may result into a weaker magnetic attraction to the developing roller 115, by which the magnetic carrier 135 may be more likely to adhere the photosensitive drum 108, which is not a desirable phenomenon.

If the magnetic carrier 135 may have too great average particle diameter (e.g., more than 50 μm), the magnetic carrier 135 and an electrostatic latent image on the photosensitive drum 108 may form a weaker magnetic field therebetween, which may result into a poor quality image such as uneven toner concentration, which is also not a desirable phenomenon.

The core 136 may be made of a magnetic material such as ferrite formed into a spherical shape, for example. The resin coat layer 137 coats an external surface of the core 136. The resin coat layer 137 may include resin such as cross-linked resin (e.g., melamine resin and thermoplastic resin such as acrylic resin) and a charge control agent. Such resin coat layer 137 has elasticity and strong adhesivity, for example. The alumina particles 138 may have an outer diameter, set greater than a thickness of the resin coat layer 137, by which the alumina particles 138 may protrude from a surface of the resin coat layer 137. The alumina particles 138 are held in the resin coat layer 137 by adhesivity of the resin coat layer 137.

In an exemplary embodiment, the development unit 113 may employ the developing agent 126 including the magnetic carrier 135 having an average particle diameter of 20 μm to 50 μm, which may have a good level of sphericity, by which an image can be produced with a good level of toner concentration.

A description is now given to a process cartridge with reference to FIG. 10. Each of process cartridges 106Y, 106M, 106C, and 106K may include a cartridge case 111, a charge roller 109, the photosensitive drum 108, a cleaning blade 112, and the development unit 113, for example.

The cartridge case 111 may be detachable from an image forming apparatus 101 (see FIG. 11), and encases the charge roller 109, the photosensitive drum 108, the cleaning blade 112, and the development unit 113. The charge roller 109 charges an external surface the photosensitive drum 108 uniformly. The photosensitive drum 108, facing the developing roller 115 in the development unit 113 with a given gap therebetween, has a cylindrical shape and is rotatable about its axial center.

The developing roller 115 (or the developing sleeve 132) and the photosensitive drum 108 preferably set a given gap of 0.1 mm to 0.4 mm therebetween, in which protruded aggregated chains of the developing agent 126 may supply toner particles from the developing sleeve 132 to the photosensitive drum 108 reliably, by which an image having higher quality can be produced.

If such given gap may become too small (e.g., less than 0.1 mm), the developing sleeve 132 and the photosensitive drum 108 may form too strong magnetic field therebetween, which may cause a transfer of the magnetic carrier 135 to the photosensitive drum 108, which is not a desirable phenomenon.

If such given gap may become too great (e.g., more than 0.4 mm), the developing sleeve 132 and the photosensitive drum 108 may form too weak magnetic field therebetween, which may undesirably decrease developability by toner particles on the photosensitive drum 108, and such weak magnetic field may cause a greater edge effect on image edges resulting into undesirable image quality such as uneven toner concentration.

The process cartridges 106Y, 106M, 106C, and 106K transfers images to a recording sheet 107 as follows.

Figure 11:
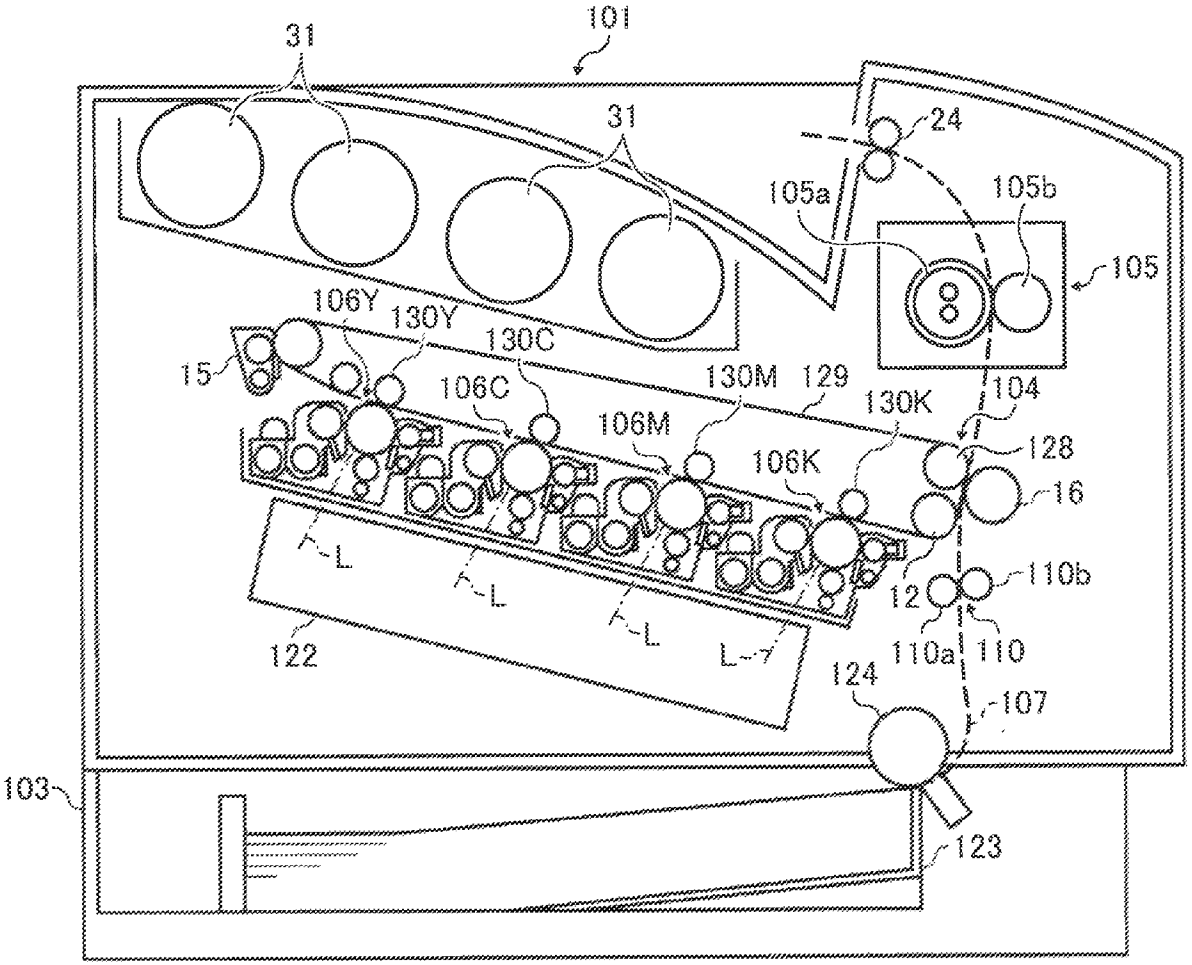
FIG. 11 illustrates a cross-sectional view of an image forming apparatus according to an exemplary embodiment.

As illustrated in FIG. 11, the image forming apparatus 101 includes an optical writing unit 122. The optical writing unit 122 irradiates a laser beam on the photosensitive drum 108 in the process cartridge 106 to form an electrostatic latent image on the photosensitive drum 108. The electrostatic latent image on the photosensitive drum 108 is developed with toner particles supplied from the development unit 113. Then, the toner image is transferred to a transfer belt 129, and further transferred to the recording sheet 107. After such toner image transfer to the recording sheet 107, the cleaning blade 112 removes toner particles remaining on the surface of the photosensitive drum 108.

In an exemplary embodiment, the process cartridge 106 employs the development unit 113, which can supply the developing agent 126 to a circumferential direction of the photosensitive drum 108 more uniformly. In other words, the developing agent 126 can be supplied to a direction of rotation of the photosensitive drum 108 more uniformly. Therefore, the amount of developing agent 126 that the developing sleeve 132 can carry does not deteriorate over time and images having appropriate concentrations of toner can continue to be produced.

A description is now given to an image forming apparatus with reference to FIG. 11. The image forming apparatus 101 may form color images of yellow (Y), magenta (M), cyan (C), and black (K) on the recording sheet 107. Hereinafter, yellow, magenta, cyan, and black are indicated by suffix letter of Y, M, C, and K, respectively.

As illustrated in FIG. 11, the image forming apparatus 101 may include a sheet feed unit 103, a registration roller 110, a transfer unit 104, a fixing unit 105, the optical writing unit 122, and the process cartridge 106Y, 106M, 106C, and 106K, for example.

The sheet feed unit 103 is provided at a bottom of the image forming apparatus 101, for example. The sheet feed unit 103 includes a sheet cassette 123 and a feed roller 124. The sheet cassette 123 stores the recording sheet 107, and the feed roller 124 is pressed to a top sheet in the sheet cassette 123. The feed roller 124 feeds the recording sheet 107 to the registration roller 110.

The registration roller 110, disposed in a transportation route of the recording sheet 107, includes rollers 110*a* and 110*b*. The rollers 110*a* and 110*b* sandwich the recording sheet 107, and feed the recording sheet 107 to a space between the transfer unit 104 and a secondary transfer roller 16, to be described later.

The transfer unit 104, provided over the sheet feed unit 103, includes a drive roller 128, a driven roller 12, the transfer belt 129, and primary transfer rollers 130Y, 130M, 130C, and 130K, for example. A motor or the like (not shown) drives the drive roller 128, and the driven roller 12 is rotatably supported in the image forming apparatus 101. The transfer belt 129, formed into an endless belt, is extended by the drive roller 128 and the driven roller 12. The transfer belt 129 travels in a given direction when the drive roller 128 rotates.

The primary transfer rollers 130Y, 130M, 130C, 130K and the photosensitive drum 108 of each of the process cartridges 106Y, 106M, 106C, 106K sandwich the transfer belt 129. The transfer unit 104 transfers toner images formed on the photosensitive drum 108 to the transfer belt 129 with an effect of the primary transfer rollers 130Y, 130M, 130C, and 130K, and then the transfer belt 129 transfers the toner image to the recording sheet 107 with an effect of the secondary transfer roller 16. Then, the recording sheet 107 is transported to the fixing unit 105.

The fixing unit 105 includes rollers 105*a* and 105*b* for sandwiching the recording sheet 107 therebetween. The rollers 105*a* and 105*b* applies heat and pressure to the recording sheet 107 to fix the toner image on the recording sheet 107.

The optical writing unit 122 attached to the image forming apparatus 101 emits a laser beam to an external surface of the photosensitive drum 108, uniformly charged by the charge roller 109, of the process cartridges 106Y, 106M, 106C, and 106K, to form an electrostatic latent image on the photosensitive drum 108.

The process cartridges 106Y, 106M, 106C, and 106K may be disposed between the transfer unit 104 and the optical writing unit 122, and detachable from the image forming apparatus 101, for example. The process cartridges 106Y, 106M, 106C, and 106K may be arranged in a tandem manner, for example.

After the above-described image forming process, a belt cleaning unit 15 removes toner particles remaining on the transfer belt 129, and toner particles are recovered to an toner waste bottle (not shown).

The above-described secondary transfer roller 16 is applied with a bias voltage opposite to toner particles on the transfer belt 129 to transfer toner image from the transfer belt 129 to the recording sheet 107.

After fixing the toner image on the recording sheet 107, an ejection roller 24 ejects the recording sheet 107 from the image forming apparatus 101.

Further, the image forming apparatus 101 may include toner bottles 31 storing Y, M, C, and K toner. Respective color toner may be refilled from the toner bottles 31 to each of the process cartridge 106Y, 106M, 106C, and 106K via a toner transport route (not shown).

Accordingly, the image forming apparatus 101 forms images on the recording sheet 107, which may be summarized as below. When the photosensitive drum 108 rotates, the charge roller 109 charges the photosensitive drum 108. A laser beam is irradiated on the photosensitive drum 108 to form an electrostatic latent image. When the electrostatic latent image comes to the developing area 131 of the development unit 113, the electrostatic latent image is developed as toner image by the developing agent 126 supplied from the developing sleeve 132. The toner image is then transferred to the transfer belt 129, and further transferred to the recording sheet 107 transported from the sheet feed unit 103. And the fixing unit 105 fixes the image on the recording sheet 107 as color image.

In an exemplary embodiment, the image forming apparatus 101 employs the development unit 113 which can supply the developing agent 126 to a circumferential direction of the photosensitive drum 108 more uniformly. In other words, the developing agent 126 can be supplied to a direction of rotation of the photosensitive drum 108 more uniformly. Accordingly, a toner image can be developed on the photosensitive drum 108 by decreasing unevenness of image concentration, by which an image having higher quality can be produced on a transfer member. Therefore, the amount of developing agent 126 that the developing sleeve 132 can carry does not deteriorate over time and images having appropriate concentrations of toner can continue to be produced.

A description is now given to a surface treatment machine and magnetic abrasive grain for forming depressions having elliptical shape on an external surface of a hollow structure (e.g., developing roller 115) with reference to FIGS. 12 to 17, in which a magnetic abrasive grain 65 is impacted against the external surface of the hollow structure to form depressions on the hollow structure.

Figure 12:
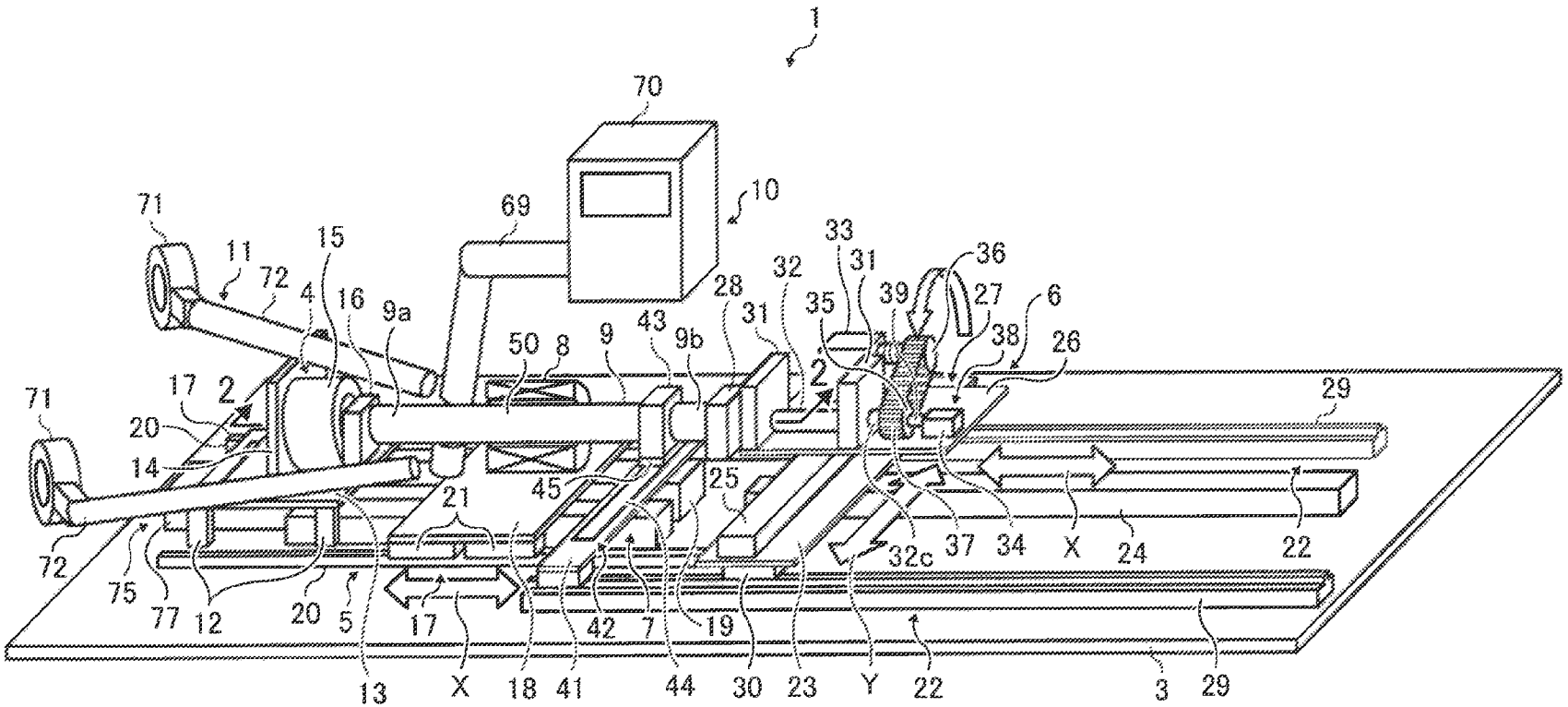
FIG. 12 illustrates a perspective view of a surface treatment machine used for conducting surface roughening process to the external surface of the hollow structure of FIG. 2.
Figure 13:
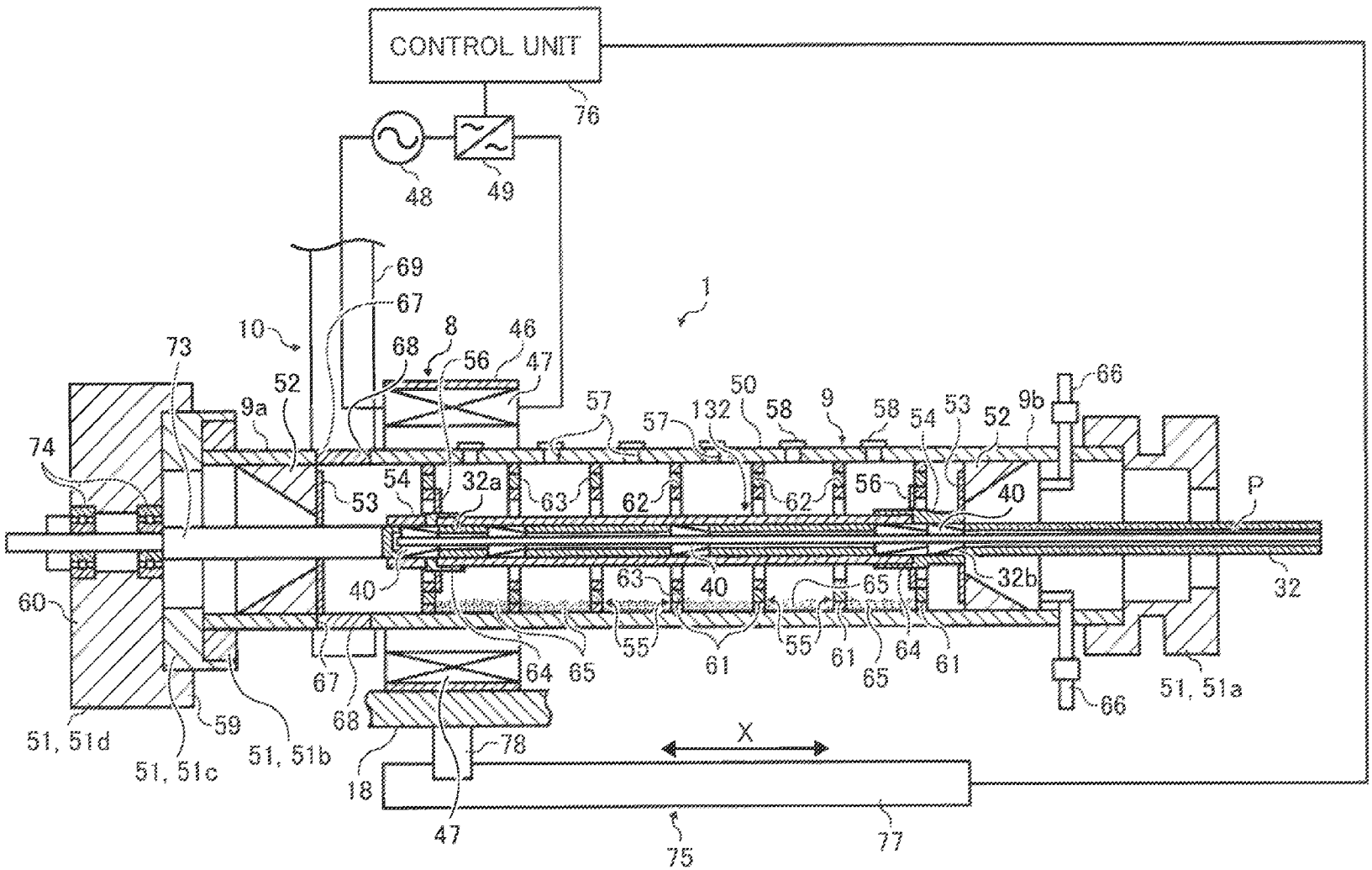
FIG. 13 illustrates a cross-sectional view of the surface treatment machine, taken along the line 2-2 of FIG. 12.

As illustrated in FIGS. 12 and 13, the surface treatment machine 1 may include a base 3, a fixed holding unit 4, a electromagnetic coil moving unit 5, a movable holding unit 6, a movable chuck unit 7, an electromagnetic coil 8, a container unit 9, a collection unit 10, a cooling unit 11, a linear encoder 75, and a control unit 76, for example.

The base 3 is formed into a plate-like shape, and is installed on a floor, a table or the like in a factory. The base 3 has an upper face maintained parallel to the horizontal direction. The base 3 is formed into a rectangular shape, for example.

The fixed holding unit 4 may include a plurality of columns 12, a holding base 13, a standing bracket 14, a cylindrical holding member 15, and a holding chuck 16. The columns 12 may be standing on the base 3, for example.

The holding base 13 is formed into a plate-like shape, and attached to an upper end portion of the columns 12. The standing bracket 14, formed into a plate-like shape, is protruded from the holding base 13.

The cylindrical holding member 15, formed into a cylindrical shape, is attached to the standing bracket 14 and the holding base 13. The cylindrical holding member 15 is disposed closer to a center portion of the base 3 compared to the standing bracket 14, and the axial center of the cylindrical holding member 15 is parallel to the horizontal direction and the direction shown by an arrow X. The cylindrical holding member 15 houses the flange 51*b*, 51*c*, and 51*d* (to be described later) attached to a first end portion 9*a* (to be described later) of the container unit 9.

The holding chuck 16, disposed near the cylindrical holding member 15 and the holding base 13, is attached to the base 3. The holding chuck 16 chucks the container unit 9 having the first end portion 9*a*, housed in the cylindrical holding member 15, to hold the first end portion 9*a* of the container unit 9. The fixed holding unit 4 also holds the first end portion 9*a* of the container unit 9.

The electromagnetic coil moving unit 5 may include a pair of linear guides 17, an electromagnetic coil holding base 18, an electromagnetic coil moving actuator 19. The linear guides 17 may include rails 20, and a slider 21. The rails 20 are installed on the base 3. The rails 20, formed into a straight line shape, are disposed to parallel to the longitudinal direction (or an arrow X) of the base 3. The slider 21 is slidably supported on the rails 20 in the longitudinal direction (or an arrow X) of the rails 20. In the pair of the linear guides 17, the rails 20 are arranged with a given distance each other in a width direction (hereinafter, refer to an arrow Y) of the base 3. The arrow X and the arrow Y, perpendicular to each other, and parallel to the horizontal direction.

The electromagnetic coil holding base 18, formed into a plate-like shape, is attached to the slider 21. The electromagnetic coil holding base 18 has an upper face, which is parallel to the horizontal direction. The electromagnetic coil holding base 18 holds the electromagnetic coil 8 thereon.

The electromagnetic coil moving actuator 19, attached to the base 3, is used to slidably move the electromagnetic coil holding base 18 in the direction of the arrow X. The electromagnetic coil moving unit 5 slidably moves the electromagnetic coil holding base 18 and the electromagnetic coil 8 in the direction of the arrow Y by using the electromagnetic coil moving actuator 19. Further, the electromagnetic coil moving unit 5 can change a moving speed of the electromagnetic coil 8 in a range of 0 mm/sec to 300 mm/sec, for example. Further, the electromagnetic coil moving unit 5 can move the electromagnetic coil 8 in a movable range of 600 mm or so.

The movable holding unit 6 may include a pair of linear guides 22, a holding base 23, a first actuator 24, a second actuator 25, a moving base 26, a bearing rotation unit 27, and a holding chuck 28.

The linear guides 22 may include rails 29, and the slider 30. The rails 29 are installed on the base 3. The rails 29, formed into a straight line shape, are disposed parallel to the longitudinal direction (or the arrow X) of the base 3. The slider 30 is slidably supported on the rails 29 in the longitudinal direction (or the arrow X) of the rails 29. The pair of the linear guides 22 are arranged with a given distance each other in the width direction (or the direction shown by the arrow Y) of the base 3.

The holding base 23, formed into a plate-like shape, is attached to the slider 30. The holding base 23 has an upper face, which is parallel to the horizontal direction. The first actuator 24, attached to the base 3, is used to slidably move the holding base 23 in the direction of the arrow X.

The second actuator 25, attached to the holding base 23, is used to slidably move the moving base 26 in the direction of the arrow Y. The moving base 26, formed into a plate-like shape, has an upper face, which is parallel to the horizontal direction.

The bearing rotation unit 27 may include a pair of bearings 31, a hollow object holding member 32, a drive motor 33, a chuck cylinder 34. The pair of bearings 31, arranged with a given distance each other in the direction of the arrow X, are installed on the moving base 26.

The hollow object holding member 32 may be made of a magnetic material, and formed into a cylindrical shape. The hollow object holding member 32, supported by the bearings 31, is rotatable about its axial center. The hollow object holding member 32 has its axial center, which is arranged parallel to the axial center of the cylindrical holding member 15 or the direction of the arrow X. The hollow object holding member 32 has a first end portion 32*a* (see FIG. 13), which is inserted in the container unit 9, and a second end portion 32*c* (see FIG. 12) disposed over the moving base 26. As illustrated in FIG. 13, the hollow object holding member 32 is inserted in the developing sleeve 132 having a cylindrical shape. Further, the second end portion 32*c* of the hollow object holding member 32 is fixed to a pulley 35 placed over the moving base 26. The pulley 35 is disposed coaxially with the hollow object holding member 32.

The drive motor 33, installed on the moving base 26, has an output shaft attached to a pulley 36. The output shaft of the drive motor 33 has an axial center, which is parallel to the direction of the arrow X. A timing belt (or endless belt) 37 is extended by the pulleys 35 and 36.

The chuck cylinder 34 includes a cylinder body 38, and a chuck shaft 39, wherein the cylinder body 38 is mounted on the moving base 26, and the chuck shaft 39 is slidably provided to the cylinder body 38. The chuck shaft 39, formed into a cylindrical shape, is disposed parallel to the direction of the arrow X. The chuck shaft 39 is arranged coaxially with the hollow object holding member 32 and encased in the hollow object holding member 32. The chuck shaft 39 is provided with a plurality of chuck claws 40, which are arranged as a pair of the chuck claws.

The chuck claws 40 are protrudingly attached on an outer circumference face of the chuck shaft 39. Further, the chuck claws 40 may protrude from an outer circumference face of the hollow object holding member 32 in an outer direction of the hollow object holding member 32. A protruding amount of the chuck claws 40 from the chuck shaft 39 and the hollow object holding member 32 can be changeable. The chuck claws 40 are arranged in the longitudinal direction of the chuck shaft 39 with a given distance each other. As the chuck shaft 39 moves toward the cylinder body 38, the protruding amount of the chuck claws 40 from the chuck shaft 39 and the hollow object holding member 32 increases.

When the chuck shaft 39 moves toward the cylinder body 38, the chuck claws 40 can be more protruded from the outer circumference face of the chuck shaft 39, by which the chuck claws 40 are pressed to an inner surface of the developing sleeve 132, attached to the outer circumference face of the hollow object holding member 32. With such process, the chuck shaft 39, the hollow object holding member 32, and the developing sleeve 132 are fixed together. At this time, the chuck shaft 39, the hollow object holding member 32, the developing sleeve 132, a cylindrical member 50 (to be described later), and the container unit 9 are coaxially arranged.

Further, when the chuck claws 40 are set to unprotruded condition with respect to the outer circumference face of the hollow object holding member 32, the developing sleeve 132 and the hollow object holding member 32 is not fixed by the chuck shaft 39. In such condition, the developing sleeve 132 is rotatable in its circumferential direction (or rotation direction) about its axis center by electromotive force, which is electromagnetically induced by the electromagnetic coil 8, to be described later.

The chuck cylinder 34 and the chuck claws 40 are used to hold the hollow object holding member 32, the container unit 9, and the developing sleeve 132 coaxially. Accordingly, the chuck cylinder 34 and the chuck claws 40 hold the developing sleeve 132 in a center position of the container unit 9 in an axial direction of the container unit 9.

The holding chuck 28 is installed on the moving base 26. The holding chuck 28 chucks a flange 51*a* (to be described later) attached to a second end portion 9*b* of the container unit 9 to hold the second end portion 9*b* of the container unit 9. The holding chuck 28 regulates or restricts a rotation of the container unit 9 about its axial center.

The movable holding unit 6 moves the holding chuck 28, the hollow object holding member 32 in perpendicular directions (e.g., directions shown by the arrows X and Y) using the above-described actuators 24 and 25. Accordingly, the movable holding unit 6 moves the container unit 9, held by the holding chuck 28 in the perpendicular directions (e.g., directions shown by the arrows X and Y).

The movable chuck unit 7 includes a holding base 41, a linear guide 42, and a holding chuck 43. The holding base 41 is fixed to one end portion of the rails 29 of the linear guides 22, wherein such one end portion is closer to the fixed holding unit 4. The holding base 41, formed into a plate-like shape, has an upper face, which is parallel to the horizontal direction.

The linear guide 42 may include rails 44, and a slider 45. The rails 44 are installed on the holding base 41. The rails 44, formed into a straight line shape, are disposed parallel to the width direction (or the direction of the arrow Y) of the base 3. The slider 45 is slidably supported on the rails 44 in the longitudinal direction or the direction of the arrow Y) of the rails 44.

The holding chuck 43 is installed on the slider 45. The holding chuck 43 is placed between the holding chucks 16 and 28. The holding chuck 43 chucks the container unit 9 at a portion closer to the second end portion 9*b* to hold the container unit 9. The movable chuck unit 7 is used to position the container unit 9 at a given position when the holding chuck 43 holds the container unit 9. Further, when the holding chuck 43 holds the container unit 9, the movable chuck unit 7 and the holding chuck 28 cooperates together to hold the container unit 9 during a movement of the container unit 9 in its axial direction so that the container unit 9 does not drop from the bearing rotation unit 27 and the surface treatment machine 1.

As illustrated in FIG. 13, the electromagnetic coil 8 includes an outer cover 46, and a coil unit 47. The outer cover 46, formed into a cylindrical shape, encases the coil unit 47. The electromagnetic coil 8 has an inner diameter greater than an outer diameter of the container unit 9. Accordingly, a space is formed between inner surface of the electromagnetic coil 8 and the outer circumference face of the container unit 9. Further, a total length of the electromagnetic coil 8 is smaller than a total length of the container unit 9. Preferably, the total length of the electromagnetic coil 8 is set two thirds (⅔) or less of the total length of the container unit 9. For example, the electromagnetic coil 8 has an inner diameter of 90 mm and a length of 85 mm.

The outer cover 46 is attached to the electromagnetic coil holding base 18 while aligning the axial center of the outer cover 46 to the axial center of the electromagnetic coil 8. The electromagnetic coil 8 is arranged coaxially with the hollow object holding member 32, the chuck shaft 39, and the container unit 9.

The coil unit 47 may include coils, arranged along the circumferential direction of the outer cover 46 (or the electromagnetic coil 8). As illustrated in FIG. 13, the coil unit 47 is applied with current by a three-phase alternating current source 48. The coils of the coil unit 47, applied with current having different phases, generate magnetic fields having different phases. The electromagnetic coil 8 combines such magnetic fields to form a magnetic field (hereinafter referred as "rotated magnetic field") having a direction of rotation in the electromagnetic coil 8 about its axial center.

The electromagnetic coil 8, applied with current from the three-phase alternating current source 48 to generate such rotated magnetic field, is moved in the axial direction of the electromagnetic coil 8 (or longitudinal direction of the container unit 9) by the electromagnetic coil moving unit 5. The electromagnetic coil 8 uses such rotated magnetic field to position a magnetic abrasive grain 65, contained in the container unit 9, to the outer circumference face of the developing sleeve 132, and to rotate (or move) the magnetic abrasive grain 65 inside the container unit 9 and around the developing sleeve 132. The magnetic abrasive grain 65 may be a group of a greater number of magnetic abrasive grains. However, for the simplicity of the expression, the term of "magnetic abrasive grain 65" may be used in this disclosure while having a meaning of singular or plural abrasive grains. With such configuration, the electromagnetic coil 8 induces the magnetic abrasive grain 65 to impact against the external surface of the developing sleeve 132 by using such rotated magnetic field.

Further, an inverter 49 is provided between the three-phase alternating current source 48 and the electromagnetic coil 8 for changing a magnetic field strength. The inverter 49 can change frequency, current value, and voltage value of power applied to the electromagnetic coil 8 by the three-phase alternating current source 48. By changing frequency, current value, and voltage value of power applied to the electromagnetic coil 8 by the inverter 49, power applied to the electromagnetic coil 8 from the three-phase alternating current source 48 can be increased or decreased to change a rotated magnetic field strength generated by the electromagnetic coil 8.

As illustrated in FIG. 13, the container unit 9 may include a cylindrical member 50, a plurality of flanges 51, a pair of shaving-seal holders 52, a pair of shaving-seal plates 53, a pair of positioning members 54, a plurality of partitioning members 55, and a pair of seal plates 56, for example.

The cylindrical member 50, formed into a cylindrical shape, is used as an outer envelope of the container unit 9 and has a single wall structure. Accordingly, the container unit 9 may have an outer shell having a cylindrical shape of single wall structure. For example, the cylindrical member 50 of the container unit 9 preferably has an outer diameter of 40 mm to 80 mm, and a thickness of 0.5 mm to 2.0 mm. Further, the cylindrical member 50 preferably has an axial direction length of 600 mm to 800 mm, for example. The cylindrical member 50 may be made of a nonmagnetic material, for example.

The cylindrical member 50 is provided with a plurality of the abrasive grain supply holes 57. Each of the abrasive grain supply holes 57 passes through the cylindrical member 50 so that the outside and the inside of the cylindrical member 50 can be communicated with each other. Each of the abrasive grain supply holes 57 is attached with a seal cap 58. The abrasive grain supply holes 57 is used to take in the magnetic abrasive grain 65 into the inside of the cylindrical member 50 or to eject the magnetic abrasive grain 65 to the outside of the cylindrical member 50. The seal cap 58 caps each of the abrasive grain supply holes 57 so that the magnetic abrasive grain 65 does not run out from the cylindrical member 50 of the container unit 9.

The plurality of flanges 51 may be formed into a circular shape or a cylindrical shape, for example. In an exemplary embodiment, the plurality of flanges 51 includes four flanges, for example, and three of them (hereinafter, the flange 51*b*, 51*c*, and 51*d*) are attached to the first end portion 9*a* of the cylindrical member 50, and one of them (hereinafter, the flange 51*a*) is attached to the second end portion 9*b* of the cylindrical member 50.

The flange 51*b*, formed into a circular shape, engages an outer circumference of the cylindrical member 50. The flange 51*c*, formed into a circular shape, engages an outer circumference of the flange 51*b*. The flange 51*d* may integrally include a ring portion 59 having a circular shape and a column portion 60 having a cylindrical shape, in which the ring portion 59 may be protruded from an outer edge of the column portion 60. The ring portion 59 of the flange 51*d* engages an outer circumference of the flange 51*c*.

As illustrated in FIG. 13, the flange 51*d* rotatably supports a driven shaft 73 with a bearing 74. The driven shaft 73, formed into a cylindrical shape, is disposed coaxially with the cylindrical member 50 of the container unit 9. The driven shaft 73 has one end face, which is pressed to the hollow object holding member 32. The driven shaft 73, rotates with the hollow object holding member 32, supports the first end portion 32*a* (or free end side) of the hollow object holding member 32.

As illustrated in FIG. 13, the flange 51*a*, formed into a circular shape, engages an outer circumference of the second end portion 9*b* of the cylindrical member 50, wherein the hollow object holding member 32 passes through the flange 51*a*. The first end portion 9*a* of the cylindrical member 50 is used as one end portion of the container unit 9, and the second end portion 9*b* of the cylindrical member 50 is used as other end portion of the container unit 9.

Each of the shaving-seal holders 52 is formed into a circular shape. One of the shaving-seal holders 52 engages an inner circumference of the first end portion 9*a* of the cylindrical member 50, and other shaving-seal holder 52 engages an inner circumference of the second end portion 9*b* of the cylindrical member 50, wherein the hollow object holding member 32 passes through the other shaving-seal holder 52.

Each of the shaving-seal plates 53 is formed into a mesh-like shape. One of the shaving-seal plates 53, formed into a circular shape, is disposed in the inner circumference of the first end portion 9*a* of the cylindrical member 50 and attached to the one of the shaving-seal holders 52. Further, the driven shaft 73 passes through the one of the shaving-seal plate 53.

Other shaving-seal plate 53, formed into a circular shape, is disposed in the inner circumference of the second end portion 9*b* of the cylindrical member 50 and attached to the other shaving-seal holder 52. The hollow object holding member 32 passes through the other shaving-seal plate 53.

The shaving-seal plates 53 prevents shavings (e.g., shaved chip) getting out of the cylindrical member 50 of the container unit 9 when shavings are generated by shaving the external surface of the developing sleeve 132 with the impacted magnetic abrasive grain 65.

Each of the positioning members 54 is formed into a cylindrical shape. One of the positioning members 54 engages the outer circumference of the first end portion 32*a* of the hollow object holding member 32. Other positioning member 54 engages the outer circumference of a center portion 32*b* of the hollow object holding member 32, which is closer to the second end portion 9*b* of the container unit 9.

The pair of the positioning members 54 sandwich the developing sleeve 132 therebetween to position the developing sleeve 132 at a given position in the hollow object holding member 32. The first end portion 32*a* of the hollow object holding member 32 is positioned closer to the fixed holding unit 4 and far from the movable holding unit 6. The center portion 32*b* of hollow object holding member 32, positioned in the container unit 9, is far from the fixed holding unit 4 and closer to the movable holding unit 6.

The partitioning member 55 may include a frame 61, formed into a circular shape, and a mesh portion 62. The frame 61 engages and attaches the inner circumference of the cylindrical member 50, wherein the hollow object holding member 32 passes through the frame 61. As illustrated in FIG. 13, a plurality of the partitioning members 55, is disposed between the pair of the shaving-seal plates 53 with a given distance each other in the longitudinal direction of the cylindrical member 50. In FIG. 13, seven partitioning members 55 are provided, for example.

The frame 61 may include a through hole 63, to which the mesh portion 62 is attached. The mesh portion 62, formed into a mesh-like shape, allows a passage of gas and shavings (e.g., shaved chip) but do not allow a passage of the magnetic abrasive grain 65 therethrough.

The partitioning members 55 partition or segment a space in the cylindrical member 50 of the container unit 9 in an axial direction of the developing sleeve 132. The frame 61 and the mesh portion 62 of the partitioning member 55 are made of a nonmagnetic material.

Further, the developing sleeve 132 has the rotation center P, which may be aligned to the axial center of the container unit 9 and the hollow object holding member 32. Accordingly, the rotation center P of the developing sleeve 132 and the longitudinal direction of the container unit 9 are set parallel to each other.

The seal plate 56, formed into a circular shape, is further formed into a mesh-like shape to allow a passage of gas (e.g., air) and the above-described shavings (e.g., shaved chip) but not allow a passage of the magnetic abrasive grain 65. One of the seal plates 56 is attached to one of the partitioning members 55, which is closest to the first end portion 9*a*, and other seal plate 56 is attached to another one of the partitioning members 55, which is closest to the second end portion 9*b*. A cap sleeve 64 (to be described later), attached to both end of the developing sleeve 132, passes through each of the seal plates 56. The seal plates 56 may be used to prevent the magnetic abrasive grain 65 getting out from the cylindrical member 50 of the container unit 9, wherein the magnetic abrasive grain 65 is contained in spaces partitioned or segmented by the partitioning members 55.

The container unit 9 contains the magnetic abrasive grain 65, made of magnetic material, in spaces partitioned or segmented by the plurality of the partitioning members 55, and contains the developing sleeve 132, attached to the hollow object holding member 32, in the cylindrical member 50. Accordingly, the container unit 9 contains the developing sleeve 132 and the magnetic abrasive grain 65 therein.

Further, the magnetic abrasive grain 65, rotated (or moved) by the above-described rotated magnetic field, may impact against the external surface of the developing sleeve 132. When the magnetic abrasive grain 65 impacts against the external surface of the developing sleeve 132, parts of the external surface of the developing sleeve 132 are shaved by such impact, by which the external surface of the developing sleeve 132 is roughened.

As illustrated FIG. 13, the collection unit 10 may include a gas inflow tube 66, a gas ejection hole 67, a mesh member 68, a gas ejection duct 69, and a dust collector 70 (see FIG. 12). As illustrated FIG. 13, the gas inflow tube 66 is disposed into a given position of the cylindrical member 50, which is closer to the above-described other shaving-seal holder 52 and one end of the container unit 9, closer to the movable holding unit 6. The gas inflow tube 66 has an orifice, inserted in the cylindrical member 50 of the container unit 9. The gas inflow tube 66 is used to supply pressurized gas (e.g., air) to the cylindrical member 50 from a pressurized gas supply source (not shown).

The gas ejection hole 67 passes through the cylindrical member 50 so that the inside and outside of the container unit 9 are communicated with each other, and is provided to a given position between the above-described one of the shaving-seal holders 52 and an end portion of the cylindrical member 50 of the container unit 9, which are far from the movable holding unit 6. The mesh member 68 is disposed to the gas ejection hole 67 provided to the cylindrical member 50. The mesh member 68 allows a passage of shavings (e.g., shaved chip) and gas, but do not allow a passage of the magnetic abrasive grain 65. Accordingly, the mesh member 68 prevents the magnetic abrasive grain 65 getting out from the cylindrical member 50 of the container unit 9.

The gas ejection duct 69, formed in a tube shape, is attached to a near of the gas ejection hole 67. The gas ejection duct 69 encircles the outer edge of the gas ejection hole 67. The gas ejection hole 67 and the gas ejection duct 69 are used to guide gas, supplied to the cylindrical member 50 from the gas inflow tube 66, to the outside of the cylindrical member 50 of the container unit 9.

The dust collector 70, coupled to the gas ejection duct 69, sucks in gas from the gas ejection duct 69. By sucking gas from the gas ejection duct 69, the dust collector 70 sucks in the above-described shavings (e.g., shaved chip) from the cylindrical member 50 of the container unit 9 to collect the shavings (e.g., shaved chip). As such, the collection unit 10 collects the shavings (e.g., shaved chip) from the cylindrical member 50 of the container unit 9.

As illustrated in FIG. 12, the cooling unit 11 includes a cooling fan 71, and a cooling duct 72. The cooling fan 71 supplies pressurized gas (e.g., air) to the cooling duct 72, which is a tube. The cooling duct 72 guides pressurized gas (e.g., air) supplied from the cooling fan 71 to the electromagnetic coil 8, and blows pressurized gas (e.g., air) to the electromagnetic coil 8. By blowing the pressurized gas (e.g., air) to the electromagnetic coil 8, the cooling unit 11 cools the electromagnetic coil 8.

As illustrated in FIG. 13, the linear encoder 75 may include a body 77, and a detection member 78 slidably disposed to the body 77. The body 77 may have straight line shape and attached to the base 3. The body 77 is arranged between the pair of rails 20, in which the body 77 is parallel to the rails 20. The body 77 has a total length, which is longer than that of the container unit 9. The body 77 may have its both end portions, which may protrude from both end portions of the container unit 9 in the longitudinal direction of the container unit 9.

The detection member 78 is slidably provided on the body 77 in the longitudinal direction of the container unit 9. The detection member 78 is attached to the electromagnetic coil holding base 18. Accordingly, the detection member 78 is coupled to the electromagnetic coil 8 via the electromagnetic coil holding base 18.

The linear encoder 75 detects a position of the detection member 78 with respect to the body 77 (or the container unit 9), and outputs a detection result signal to the control unit 76. As such, the linear encoder 75 detects a relative position of the electromagnetic coil 8 with respect to the container unit 9 (or the developing sleeve 132), and outputs a detection result signal to the control unit 76.

The control unit 76 includes a CPU (central processing unit), a RAM (random access memory), and a ROM (read only memory), or the like. The control unit 76, connected to the electromagnetic coil moving unit 5, the movable holding unit 6, the movable chuck unit 7, the electromagnetic coil 8, the inverter 49, the collection unit 10, the cooling unit 11, and the linear encoder 75 or the like to control the surface treatment machine 1 as a whole.

The control unit 76 stores a rotated magnetic field strength of the electromagnetic coil 8, which is determined based on a relative position of the electromagnetic coil 8 with respect to the developing sleeve 132, wherein such relative position of the electromagnetic coil 8 is detected by the linear encoder 75, for example.

Accordingly, the control unit 76 stores power value to be applied to the electromagnetic coil 8 by the inverter 49, in which power value is determined based on a relative position of the electromagnetic coil 8 with respect to the developing sleeve 132. Further, the control unit 76 may store such power value for each type (e.g., product number) of the developing sleeve 132, for example.

In an exemplary embodiment, the control unit 76 stores a given power pattern or profile, in which a power value to be applied to the electromagnetic coil 8 from the inverter 49, is increased gradually in a longitudinal direction (or axial direction) of the developing sleeve 132 when the electromagnetic coil 8 moves over the developing sleeve 132 from the center portion toward the each end portion of the developing sleeve 132, for example. The control unit 76 controls the inverter 49 with such given power pattern or profile to change a rotated magnetic field strength generated by the electromagnetic coil 8.

As such, in an exemplary embodiment, the control unit 76 controls the inverter 49 and the electromagnetic coil 8 as above described so that a rotated magnetic field strength generated by the electromagnetic coil 8 becomes greater when to process the both end portions of the developing sleeve 132 compared to when to process the center portion of the developing sleeve 132, for example.

As above described, the control unit 76 stores a rotated magnetic field strength of the electromagnetic coil 8, which is determined based on a relative position of the electromagnetic coil 8 with respect to the developing sleeve 132, wherein such relative position of the electromagnetic coil 8 is detected by the linear encoder 75, and the control unit 76 stores corresponding power value to be applied to the electromagnetic coil 8 by the inverter 49.

Further, the control unit 76 is connected to an input unit such as keyboard, and a display unit such as LCD (liquid crystal display), for example.

Figure 14:
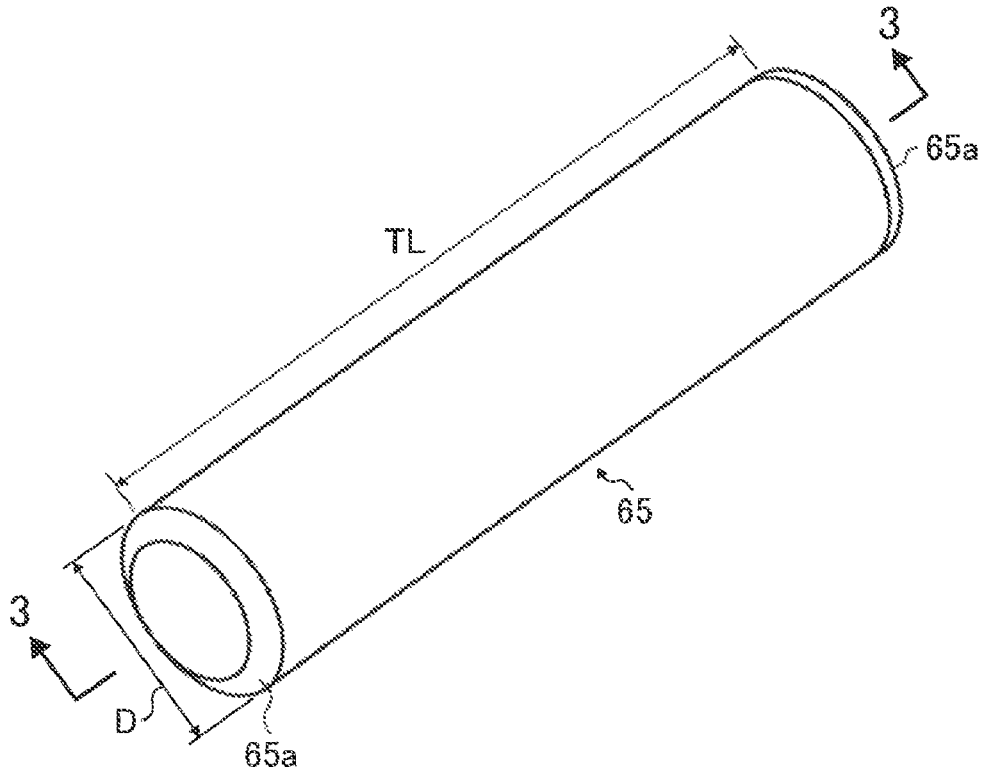
FIG. 14 illustrates a perspective view of a magnetic abrasive grain used in the surface treatment machine of FIG. 12.

A description is now given to the magnetic abrasive grain 65, used for the surface treatment machine 1 with reference to FIG. 14. As illustrated in FIG. 14, the magnetic abrasive grain 65 has a cylindrical-like shape having a relatively short length. The magnetic abrasive grain 65 may be made of a magnetic material such as austenitic stainless steel, martensitic stainless steel, or the like, for example. Although austenitic stainless steel may be generally used as non-magnetic material, austenitic stainless steel may be provided with magnetic property by processing austenitic stainless steel with a cold work or the like, in which austenitic stainless steel may become martensitic stainless steel having magnetic property. Because such austenitic stainless steel or martensitic stainless steel are materials available on the market, the magnetic abrasive grain 65 can be preferably fabricated with austenitic stainless steel or martensitic stainless steel with reasonable cost or a reduced cost.

The magnetic abrasive grain 65 may have a given dimension. For example, the magnetic abrasive grain 65 may have an outer diameter of 0.1 mm to 2.0 mm, for example. When the magnetic abrasive grain 65 has a total length TL and an outer diameter D, the magnetic abrasive grain 65 may be formed into a shape having a TL/D value of 2 to 20, for example.

With such configured magnetic abrasive grain 65, an outer edge 65*a* of the magnetic abrasive grain 65 may reliably impact against the developing sleeve 132, and the magnetic abrasive grain 65 has a total length, which may preferably form a sufficient depth of concavities and convexities on the external surface of the developing sleeve 132 when the magnetic abrasive grain 65 impacts against the developing sleeve 132.

Figure 15:
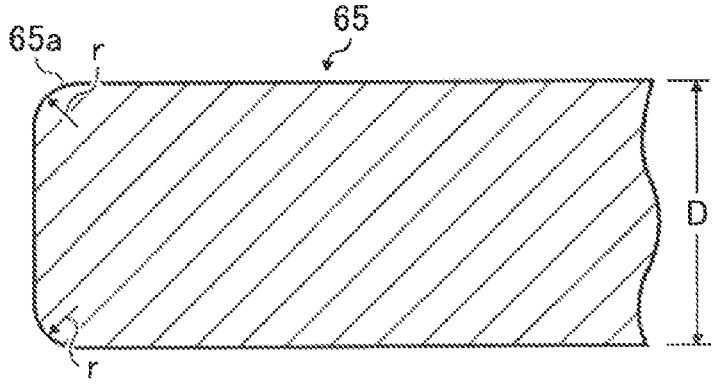
FIG. 15 illustrates an expanded view of the magnetic abrasive grain of FIG. 14, taken along the line 3-3 of FIG. 14.

Further, as illustrated in FIGS. 14 and 15, the outer edge 65*a* of the magnetic abrasive grain 65 is chamfered around its periphery and has a circular arc shape in a cross sectional view. The outer edge 65*a* is formed to have a given curvature radius r of 0.03 mm to 0.5 mm, for example. Such magnetic abrasive grain 65 may have a preferable shape for forming concavities and convexities on an external surface of to-be-processed object in a mild manner.

Figure 16:
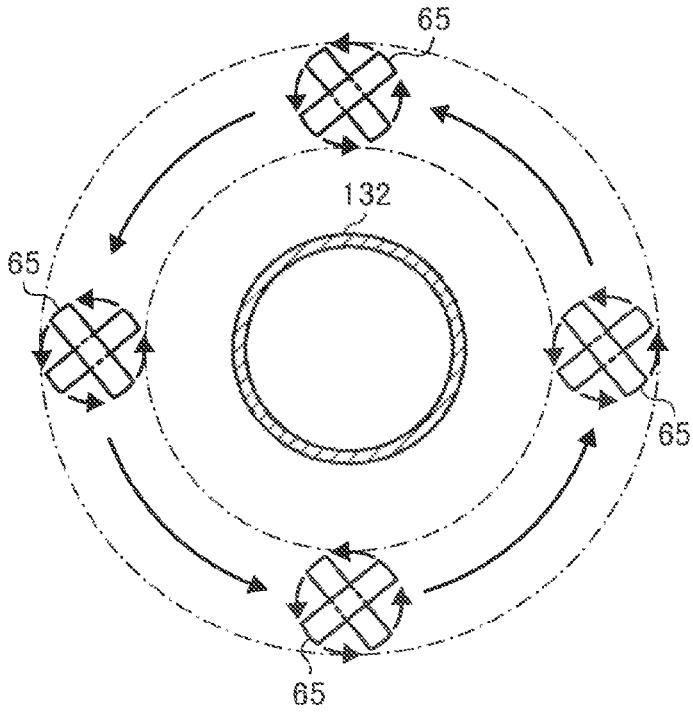
FIG. 16 illustrates schematic cross-sectional view of a magnetic abrasive grain and a hollow structure to be treated in the surface treatment machine of FIG. 12, in which the magnetic abrasive grain rotates about its center while rotatingly moves along an outer circumference of the hollow structure.

As illustrated in FIG. 16, with an effect of rotated magnetic field generated in the surface treatment machine 1, the magnetic abrasive grain 65 rotates about its center of its longitudinal direction while rotatingly moving along the circumferential direction of the developing sleeve 132 and the container unit 9.

A description is now given to a surface roughening process of the developing sleeve 132 using the surface treatment machine 1, in which the external surface of the developing sleeve 132 is roughened by the magnetic abrasive grain 65.

First, the control unit 76 is input with information such as product number of the developing sleeve 132 by using an input unit such as touch panel. Then, the cap sleeve 64 having a cylindrical shape is engaged to the outer circumference of the developing sleeve 132 at both end portion of the developing sleeve 132.

The above-described other positioning member 54 is then engaged to the outer circumference of the hollow object holding member 32, and the hollow object holding member 32 is then inserted into the developing sleeve 132, attached with the cap sleeve 64 to its both end portion. Next, the above-described one of the positioning members 54 is also engaged to the outer circumference of the hollow object holding member 32.

In an exemplary embodiment, the developing sleeve 132 is rotatable in its circumferential direction of about its axial center when the developing sleeve 132 is not fixed to the hollow object holding member 32 by the chuck claws 40. If the chuck claws 40 may be set to a protruded condition with respect to the outer circumference face of the hollow object holding member 32, the developing sleeve 132 and the hollow object holding member 32 may be fixed by the chuck shaft 39.

At this time, the developing sleeve 132 is coaxially disposed in the hollow object holding member 32 while maintaining a given level of clearance (e.g., less than one millimeter) between the developing sleeve 132 and the hollow object holding member 32.

Then, the developing sleeve 132 and the hollow object holding member 32 are housed in the container unit 9, and the magnetic abrasive grain 65 is supplied into the cylindrical member 50 of the container unit 9. With such process, the magnetic abrasive grain 65 and the developing sleeve 132 are housed in the container unit 9.

Further, the container unit 9 is chucked by the holding chucks 28 and 43. With such process, the developing sleeve 132 and the container unit 9 are attached to the movable holding unit 6, in which the cylindrical member 50, the hollow object holding member 32, and the developing sleeve 132 are coaxially disposed.

The movable holding unit 6 is attached to the developing sleeve 132 and the container unit 9 by adjusting a position of the moving base 26 with the above-described actuators 24 and 25, and also adjusting a position of the holding base 41. Then, the first end portion 9*a* of the container unit 9 is held by the fixed holding unit 4 by chucking the first end portion 9*a* of the container unit 9 with the holding chuck 16.

Then, gas is supplied into the container unit 9 through the gas inflow tube 66 of the collection unit 10, and the dust collector 70 sucks gas from the container unit 9. Further, the cooling unit 11 blows pressurized gas (e.g., air) to the electromagnetic coil 8.

Then, the electromagnetic coil 8 is applied with power from the three-phase alternating current source 48 to generate a rotated magnetic field having a frequency of 200 Hz or more, for example. With such generated rotated magnetic field, an eddy current is generated in the developing sleeve 132. Such rotated magnetic field and eddy current may cause an electromagnetic induction electromotive force, by which the developing sleeve 132 rotates with a rotation number substantially corresponding to the frequency of the rotated magnetic field.

Further, the magnetic abrasive grain 65, placed in an area receivable of an magnetic field effect of the electromagnetic coil 8, rotatingly moves along the outer circumference of the developing sleeve 132 while rotating about the center of the magnetic abrasive grain 65, by which the magnetic abrasive grain 65 impacts against the external surface of the developing sleeve 132 to roughen the external surface of the developing sleeve 132.

During such roughening process, the electromagnetic coil moving unit 5 may consecutively shift or move the electromagnetic coil 8 in the longitudinal direction of the electromagnetic coil 8 in a timely manner. With such shifting or moving of the electromagnetic coil 8, the magnetic abrasive grain 65 newly entering an magnetic field space of the electromagnetic coil 8 starts to move (i.e., rotation about its center and rotation around the developing sleeve 132) with an effect of the above-described rotated magnetic field, and the magnetic abrasive grain 65 getting out of the magnetic field space of the electromagnetic coil 8 stops its movement.

When the magnetic abrasive grain 65 enters an magnetic field space of the electromagnetic coil 8, the magnetic abrasive grain 65 may randomly and omnidirectionally impact against the surface of the developing sleeve 132, which may mean magnetic abrasive grains are impacting against the developing sleeve 132 from substantially any directions with respect to the surface of the developing sleeve 132 at a substantially same timing. Accordingly, compared to a conventional sandblasting process which may impact abrasive grains against an object from one direction at one time, the developing sleeve 132 may receive impacting stress uniformly on its surface when forming the depressions 139 by the surface processing machine 1 according to an exemplary embodiment, which may be preferable for suppressing a shape deformation of the developing sleeve 132 (e.g., misaligned axis, change of inner/outer diameter, collapsing of sleeve shape).

Further, because the partitioning members 55 partition or segment a space in the container unit 9, the magnetic abrasive grain 65 is prevented from moving beyond each of the partitioning members 55, by which the magnetic abrasive grain 65 getting out of the magnetic field space of the electromagnetic coil 8 also gets out from the above-described rotated magnetic field of the electromagnetic coil 8. When the electromagnetic coil moving unit 5 reciprocally moves the electromagnetic coil 8 in the direction shown by the arrow X with a given number of times, the surface roughening process for the external surface of the developing sleeve 132 has completed.

In an exemplary embodiment, a rotated magnetic field strength generated by the electromagnetic coil 8 may be set to a greater value when to process the both end portions of the developing sleeve 132 compared to when to process the center portion of the developing sleeve 132, for example. In other words, a rotated magnetic field strength generated by the electromagnetic coil 8 may become gradually greater in the direction from the center portion to the both end portion of the developing sleeve 132, for example.

The greater the rotated magnetic field strength, the more vibrant the magnetic abrasive grain 65 moves. Accordingly, as the rotated magnetic field strength increases, the magnetic abrasive grain 65 impacts against a to-be-processed object (e.g., the developing sleeve 132) with greater force, by which depth of depressions formed on the surface of the developing sleeve 132 may become gradually greater or deeper in the longitudinal (or axial) direction along the developing sleeve 132. Accordingly, depressions formed on an end portion of the developing sleeve 132 may have a greater depth compared to depressions formed on a center portion of the developing sleeve 132.

When such surface roughening process for the external surface of the developing sleeve 132 has completed, a power application to the electromagnetic coil 8 is stopped, and a power application to the collection unit 10 and the cooling unit 11 is also stopped. Then, the holding chuck 16 is released from holding the container unit 9 to the fixed holding unit 4. After such releasing, the moving base 26 is departed from the fixed holding unit 4 in the direction of the arrow X by using the first actuator 24 while holding the container unit 9 with the holding chuck 43 of the movable chuck unit 7 and the holding chuck 28 of the movable holding unit 6. With such process, the container unit 9 is departed from the fixed holding unit 4. Then, the developing sleeve 132 having treated with the surface roughening process can be removed from the container unit 9.

With the above-described surface roughing process, the developing sleeve 132 having a roughened external surface (see FIG. 2) can be fabricated, in which depth of depressions on the developing sleeve 132 may gradually become greater or deeper in the direction from the center portion to the both end portions of the developing sleeve 132. The developing sleeve 132 according to an exemplary embodiment may have such depressions randomly formed on the developing sleeve 132 while changing depth of depressions as above described, for example. Such depth change of depressions may be provided to the developing sleeve 132 to suppress a degradation of developability at end portions of a developing sleeve, which may be caused by given factors other than developing sleeve.

Then, another new developing sleeve is set and housed in the container unit 9 for performing another surface roughness process.

In an exemplary embodiment, when the surface treatment machine 1 is used for performing the surface roughening process to the external surface of the developing sleeve 132, the electromagnetic coil 8 generates a rotated magnetic field, which generate an eddy current in the developing sleeve 132. Such rotated magnetic field and eddy current may cause an electromagnetic induction electromotive force, by which the developing sleeve 132 rotates with a rotation number substantially corresponding to the frequency of the rotated magnetic field.

Further, as illustrated in FIG. 16, with an effect of the rotated magnetic field, the magnetic abrasive grain 65, placed in a position inside the electromagnetic coil 8, rotatingly moves along the outer circumference of the developing sleeve 132 while rotating about the center of the magnetic abrasive grain 65, by which the magnetic abrasive grain 65 impacts against the external surface of the developing sleeve 132 to roughen the external surface of the developing sleeve 132. The magnetic abrasive grain 65, rotating about its center, rotates with a rotation number substantially corresponding to the frequency of the rotated magnetic field.

Because the direction of rotation of the magnetic abrasive grain 65, rotating about its center, and the direction of rotation of the developing sleeve 132 are a same direction as illustrated in FIG. 16, the outer edge 65*a* of the magnetic abrasive grain 65 impacts against the developing sleeve 132 with a relative speed, which is proportional to the square value of the frequency of the rotated magnetic field.

Accordingly, the greater the frequency of the rotated magnetic field, the greater the relative speed of the magnetic abrasive grain 65, by which a size of the depressions formed on the external surface developing sleeve 132 by impacting the magnetic abrasive grain 65 per unit time becomes greater in the circumferential direction of the developing sleeve 132, and the long axis of the depressions on the external surface of the developing sleeve 132 may be more likely to align in the circumferential direction (or rotation direction) of the developing sleeve 132.

Further, because an impact force of the magnetic abrasive grain 65 proportionally increases as the relative speed increases, the outer edge 65*a* of the magnetic abrasive grain 65 may rotatingly impact against the external surface of the developing sleeve 132 to scrape or scoop up the external surface of the developing sleeve 132 if the relative speed is effectively greater.

Further, because a greater number of the magnetic abrasive grain 65 may move as illustrated in FIG. 16, a greater number of depressions, having elliptical shape and formed on the external surface of the developing sleeve 132, may be formed on the developing sleeve 132 by aligning the long axis of the elliptical shape in the circumferential direction of the developing sleeve 132.

Further, because a rotation kinetic energy of the magnetic abrasive grain 65 may be consumed when the magnetic abrasive grain 65 impacts against the external surface of the developing sleeve 132 and starts to scrape or scoop up the external surface of the developing sleeve 132 for forming the depressions 139, the rotation kinetic energy of the magnetic abrasive grain 65 may be substantially lost during a formation of the depressions 139. When the rotation kinetic energy of the magnetic abrasive grain 65 is substantially lost, the magnetic abrasive grain 65 may be bounced from the developing sleeve 132. Because such rotation kinetic energy of the magnetic abrasive grain 65 may be substantially lost when the magnetic abrasive grain 65 impacts against the external surface of the developing sleeve 132 and scrapes or scoops up some portions of the developing sleeve 132 right after such initial impacting of the magnetic abrasive grain 65, the depression 139 may have a cross sectional shape, which may be asymmetrical in its frontward and rearward direction as illustrated in FIG. 17, in which the depression 139, having elliptical shape and formed on the external surface of the developing sleeve 132, may have the deepest portion 200*c* at a rearward position of the depression 139 with respect to the direction of rotation of the developing sleeve 132, wherein such direction of rotation may be a rotation direction of developing sleeve 132 when magnetic particles is attracted on developing sleeve 132.

Accordingly, as illustrated in FIG. 18, the hypothetical first line L1 outwardly extending from the deepest portion 200*c* of the depression 139 in a radial direction of the developing sleeve 132, and the hypothetical second line L2 outwardly extending from the deepest portion 200*c* to the peripheral end portion 200*a* of the depression 139 may form the angle $\alpha$ set within 45 degrees, wherein the peripheral end portion 200*a* is a rearward position of the depression 139 with respect to a direction of rotation of the developing sleeve 132, which is shown by an arrow.

Figure 17:
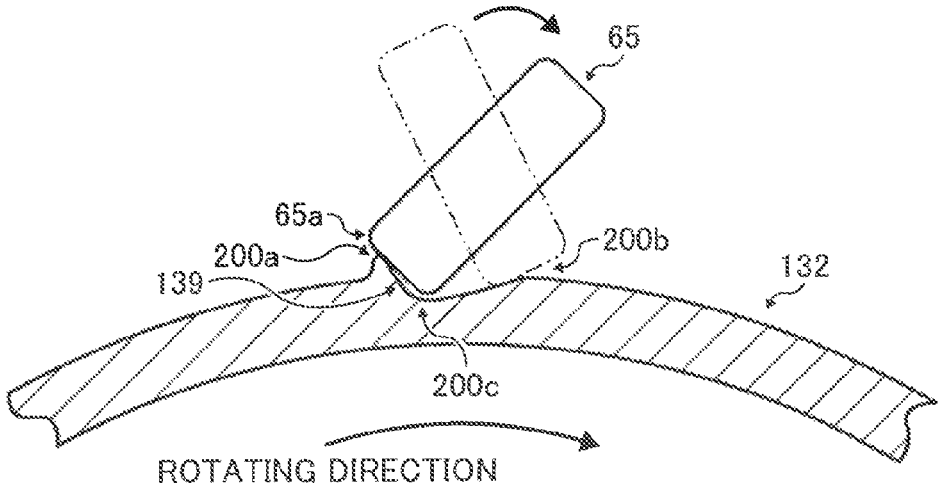
FIG. 17 illustrates a schematic cross-sectional view of a magnetic abrasive grain and a the hollow structure, in which the magnetic abrasive grain impacts against an external surface of the hollow structure.

As illustrated in FIG. 17, when the magnetic abrasive grain 65 impacts and scoop ups the external surface of the developing sleeve 132 to form the depression 139, the depression 139 may have the peripheral end portion 200*a* at its rearward position with respect to the direction of rotation of the developing sleeve 132, wherein the peripheral end portion 200*a* may protrude from the external surface of the developing sleeve 132.

Accordingly, as illustrated in FIG. 18, the depression 139 has the hypothetical straight-line segment La and the radius segment Lb. The hypothetical straight-line segment La extends from the rotation center P of the developing sleeve 132 to the peripheral end portion 200*a* of the depression 139. The radius segment Lb is one half of an outer diameter of the developing sleeve 132. In an exemplary embodiment, the hypothetical straight-line segment La may be set greater than the radius segment Lb.

Further, because a greater number of the magnetic abrasive grain 65 may rotatingly move along the circumferential direction of the developing sleeve 132 with the effect of the rotated magnetic field generated over the developing sleeve 132, a greater number of depressions 139, having elliptical shape and formed on the external surface of the developing sleeve 132, may be formed on the developing sleeve 132 by aligning the long axis of the elliptical shape in the circumferential direction of the developing sleeve 132. Such depression 139 may have the deepest portion 200*c* closer to its rearward position, and the peripheral end portion 200*a* at its rearward position while protruding from the external surface of the developing sleeve 132.

As described later with Table 1, when the rotated magnetic field frequency is set greater than 200 Hz or so, a number of depressions aligned in the circumferential direction (or rotation direction) of the developing sleeve 132 may become greater than a number of depressions aligned in the axial direction of the developing sleeve 132. Further, as described later with Table 1, when the rotated magnetic field frequency is set to 200 Hz to 400 Hz, the angle $\alpha$ may be set less than 45 degrees, and a relationship of "$20\ \mu m \geqq La - Lb > 5\ \mu m$" may be obtained.

As above described, in an exemplary embodiment, the surface treatment machine 1 and the magnetic abrasive grain 65 may be used to effectively form a greater number of the depressions 139 having elliptical shape on the external surface of the developing sleeve 132. Further, the depressions 139 may include the first depressions 139*a* having elliptical shape extending or aligning in the axial direction of the developing sleeve 132 and the second depressions 139*b* having elliptical shape extending or aligning in the circumferential direction of the developing sleeve 132, wherein the number of second depressions 139*b* is set greater than that of the first depressions 139*a*.

Accordingly, magnetic particles included in the developing agent 126 may be uniformly attracted on the external surface along the circumferential direction of the developing sleeve 132. Further, such magnetic particles may be attracted on the external surface of the developing sleeve 132 with a greater density in the circumferential direction of the developing sleeve 132 as above described. Therefore, the developing roller 115 can supply the developing agent 126 to a circumferential direction of the photosensitive drum 108 more uniformly. In other words, the developing agent 126 can be supplied to a direction of rotation of the photosensitive drum 108 more uniformly, wherein the direction of rotation of the photosensitive drum 108 is aligned to a transport direction of a transfer member such as sheet, intermediate transfer belt or the like. Accordingly, a toner image can be developed on the photosensitive drum 108 by decreasing unevenness of image concentration, by which an image having higher quality can be produced on a transfer member.

Although the developing sleeve 132 according to an exemplary embodiment may be configured to suppress unevenness of image concentration in a transport direction of a transfer member such as sheet (e.g., sheet transport direction) as above-described, such developing sleeve 132 can also preferably suppress unevenness of image concentration in a width direction (e.g., sheet width direction) of a transfer member, perpendicular to the transport direction of the transfer member. Accordingly, an image produced by using such developing sleeve 132 according to an exemplary embodiment may have a preferable level of image concentration as a whole.

Further, as above described, when the depressions 139 having elliptical shape are formed on the external surface of the developing sleeve 132 by impacting the magnetic abrasive grain 65 against the external surface of the developing sleeve 132, the magnetic abrasive grain 65 may impact against the surface of the developing sleeve 132 omnidirectionally, which may mean magnetic abrasive grains are impacting against the developing sleeve 132 from substantially any directions with respect to the surface of the developing sleeve 132 substantially at the same timing. Accordingly, compared to a conventional sandblasting process which may impact abrasive grains against an object from one direction at one time, the developing sleeve 132 may receive impacting stress uniformly on its surface when forming the depressions 139 by the surface processing machine 1 according to an exemplary embodiment, which may be preferable for suppressing a shape deformation of the developing sleeve 132 (e.g., misaligned axis, change of inner/outer diameter, collapsing of sleeve shape).

Accordingly, the developing sleeve 132 can be manufactured with a higher precision, and can rotate with a higher precision, by which an image having higher quality can be produced with a good level of toner concentration.

Further, when the surface treatment machine 1 and the magnetic abrasive grain 65 are used to form the depression 139 having elliptical shape on the external surface of the developing sleeve 132, the hypothetical first line L1 extending outwardly from the deepest portion 200*c* in a radial direction of the developing sleeve 132 and the hypothetical second line L2 extending from the deepest portion 200*c* to the peripheral end portion 200*a* of the depression 139 may form the angle $\alpha$ within 45 degrees. Such depression 139 has the peripheral end portion 200*a* at its rearward position, with respect to the direction of rotation of the developing sleeve 132, wherein the peripheral end portion 200*a* protrudes from the external surface of the developing sleeve 132. Accordingly, the depressions 139 may effectively scoop up and hold magnetic particles therein when the developing agent 126 is carried up on the developing sleeve 132. Therefore, magnetic particles may be held on the external surface of the developing sleeve 132 more reliably, by which the developing agent 126 may be held on the external surface of the developing sleeve 132 more reliably. Therefore, the amount of developing agent 126 that the developing sleeve 132 can carry does not deteriorate over time and images having appropriate concentrations of toner can continue to be produced.

Further, a depth of the depression 139 may be set to relatively smaller value in an exemplary embodiment while maintaining a good level of holding capability of developing agent, by which processing energy (e.g., mechanical force) applied to the external surface of the developing sleeve 132 can be set smaller, which may be preferable for suppressing a shape deformation of the developing sleeve 132 (e.g., misaligned axis, change of inner/outer diameter, collapsing of sleeve shape). Accordingly, the developing sleeve 132 can be manufactured with a higher precision, and can rotate with a higher precision, by which an image having higher quality can be produced with a good level of toner concentration.

A description is now given to experiments conducted for surface roughening process of a hollow structure using the surface treatment machine 1. In the experiments, current and frequency values applied to the electromagnetic coil 8 were changed for conducting the surface roughening process to the hollow structure (hereinafter, referred as the developing sleeve 132 or developing sleeve for the simplicity of expression) with a method according to an exemplary embodiment and a conventional surface roughening process. The results of the experiments were evaluated with a sensory evaluation method, which evaluates image concentration unevenness in a sheet transport direction.

Example Experiment 1

By using the surface treatment machine 1, a surface roughening process was conducted by randomly impacting the magnetic abrasive grain 65 (outer diameter: 0.8 mm, length: 5 mm, material: SUS 304) to the developing sleeve 132 (outer diameter: 18 mm, length: 240 mm, material: aluminum alloy A6063). When such surface roughening process was conducted, the electromagnetic coil 8 was applied with power having a current value of 10 A and a frequency of 200 Hz, and such surface roughening process was conducted with a processing time of 30 sec and an amount of the magnetic abrasive grain 65 of 50 g.

Example Experiment 2

The developing sleeve 132 was prepared as similar to Example Experiment 1. When such surface roughening process was conducted, the electromagnetic coil 8 was applied with power having a current value of 20 A and a frequency of 200 Hz, and such surface roughening process was conducted with a processing time of 30 sec and an amount of the magnetic abrasive grain 65 of 50 g.

Example Experiment 3

The developing sleeve 132 was prepared as similar to Example Experiment 1. When such surface roughening process was conducted, the electromagnetic coil 8 was applied with power having a current value of 20 A and a frequency of 300 Hz, and such surface roughening process was conducted with a processing time of 30 sec and an amount of the magnetic abrasive grain 65 of 50 g.

Example Experiment 4

The developing sleeve 132 was prepared as similar to Example Experiment 1. When such surface roughening process was conducted, the electromagnetic coil 8 was applied with power having a current value of 20 A and a frequency of 400 Hz, and such surface roughening process was conducted with a processing time of 30 sec and an amount of the magnetic abrasive grain 65 of 50 g.

Example Experiment 5

The developing sleeve 132 was prepared as similar to Example Experiment 1. When such surface roughening process was conducted, the electromagnetic coil 8 was applied with power having a current value of 30 A and a frequency of 200 Hz, and such surface roughening process was conducted with a processing time of 30 sec and an amount of the magnetic abrasive grain 65 of 50 g.

Comparison Experiment 1

A developing sleeve was prepared by forming grooves on its external surface, wherein the grooves have a length of 220 mm, a width of 0.1 mm, a depth of 0.2 mm, and a groove-to-groove interval of 0.18 mm.

Comparison Experiment 2

A developing sleeve was prepared by conducting a sandblasting to its external surface using alumina abrasive grain having an average particle diameter of 500 μm with a processing time of 30 sec and a jetting pressure of 4 kgf/cm$^2$.

Comparison Experiment 3

A developing sleeve was prepared by conducting a sandblasting to its external surface using alumina abrasive grain having an average particle diameter of 50 μm with a processing time of 30 sec and a jetting pressure of 4 kgf/cm$^2$.

Comparison Experiment 4

A developing sleeve was prepared as similar to Example Experiment 1. When such surface roughening process was conducted, the electromagnetic coil 8 was applied with power having a current value of 10 A and a frequency of 150 Hz, and such surface roughening process was conducted with a processing time of 30 sec and an amount of the magnetic abrasive grain 65 of 50 g.

Comparison Experiment 5

A developing sleeve was prepared as similar to Example Experiment 1. When such surface roughening process was conducted, the electromagnetic coil 8 was applied with power having a current value of 20 A and a frequency of 150 Hz, and such surface roughening process was conducted with a processing time of 30 sec and an amount of the magnetic abrasive grain 65 of 50 g.

Comparison Experiment 6

A developing sleeve was prepared as similar to Example Experiment 1. When such surface roughening process was conducted, the electromagnetic coil 8 was applied with power having a current value of 30 A and a frequency of 150 Hz, and such surface roughening process was conducted with a processing time of 30 sec and an amount of the magnetic abrasive grain 65 of 50 g.

Comparison Experiment 7

A developing sleeve was prepared as similar to Example Experiment 1. When such surface roughening process was conducted, the electromagnetic coil 8 was applied with power having a current value of 20 A and a frequency of 100 Hz, and such surface roughening process was conducted with a processing time of 30 sec and an amount of the magnetic abrasive grain 65 of 50 g.

Comparison Experiment 8

A developing sleeve was prepared as similar to Example Experiment 1. When such surface roughening process was conducted, the electromagnetic coil 8 was applied with power having a current value of 30 A and a frequency of 100 Hz, and such surface roughening process was conducted with a processing time of 30 sec and an amount of the magnetic abrasive grain 65 of 50 g.

The developing sleeves prepared by the above-described Example Experiments and Comparison Experiments were used for the following test.

The developing sleeves prepared by the above-described Example Experiments and Comparison Experiments were installed in an image forming apparatus (product name of IPSIO CX400 by Ricoh Co., Ltd.). The photosensitive drum 8 was charged with 620 V, and the developing bias voltage of 385 V was applied. A two-component cyan developing agent, including a carrier having an average particle diameter of 35 μm, was used as the developing agent 126, and a pick-up amount of the developing agent 126 was set to 50 mg/cm$^2$. Under such setting, a solid image of 195 mm×285 mm was output for 10,000 sheets by the image forming apparatus, and image concentration unevenness in a sheet transport direction was evaluated with a sensory evaluation method. Specifically, image concentration unevenness at initial condition of the developing sleeves and image concentration unevenness after outputting 10,000 sheets were evaluated with following criteria, and the results are shown as Table 1.

Criteria A: image concentration in a sheet transport direction is uniform, and image concentration unevenness is not observed.

Criteria B: image concentration unevenness in a sheet transport direction is observed, but no problem for practical use.

Criteria C: image concentration unevenness in a sheet transport direction is observed, and problem arises for practical use.

Further, because a surface roughening process according to an exemplary embodiment was conducted with the surface treatment machine 1 in Example Experiments 1 to 5 and Comparison Experiment 4 to 8, depressions having elliptical shape were formed on the developing sleeves. Table 1 also shows a ratio of the second depression 139*b* (see FIG. 6) in the depressions 139, extending along the circumferential direction of the developing sleeve per unit area on the developing sleeve.

TABLE 1

| | Concentration unevenness | | Ratio of second | | | |
|---|---|---|---|---|---|---|
| | Initial | After 10,000 | depression (%) | Angle α (degree) | La-Lb (μm) | Frequency (Hz) |
| Ex. 1 | A | A | 60 | 22 | 7.3 | 200 |
| Ex. 2 | A | A | 60 | 21 | 7.9 | 200 |
| Ex. 3 | A | A | 85 | 33 | 11.3 | 300 |
| Ex. 4 | A | A | 95 | 41 | 19.7 | 400 |
| Ex. 5 | A | A | 60 | 19 | 7.2 | 200 |
| Ex. 6 | A | A | 95 | 44 | 18.5 | 450 |
| Ex. 7 | A | A | 95 | 43 | 11.9 | 450 |
| Ex. 8 | A | A | 95 | 43 | 6.1 | 450 |
| CEx. 1 | C | C | — | — | — | — |
| CEx. 2 | C | C | — | — | — | — |
| CEx. 3 | C | C | — | — | — | — |
| CEx. 4 | B | B | 40 | 17 | 6.1 | 150 |
| CEx. 5 | B | B | 40 | 17 | 5.3 | 150 |
| CEx. 6 | B | B | 40 | 16 | 5.8 | 150 |
| CEx. 7 | B | B | 20 | 13 | 4.2 | 100 |
| CEx. 8 | B | B | 20 | 13 | 3.9 | 100 |
| CEx. 9 | A | B | 95 | 44 | 20.8 | 450 |
| CEx. 10 | B | B | 95 | 44 | 4.5 | 450 |
| CEx. 11 | B | B | 95 | 48 | 11.5 | 500 |

In Table 1, "Ex." represents Example Experiment and "CEx." represents Comparison Experiment.

As shown in Table 1, the developing sleeves of Example Experiments 1 to 5 and Comparison Experiments 4 to 8 prepared by the surface roughening process according to an exemplary embodiment have results that an image concentration unevenness in a sheet transport direction is smaller or little, which is a relatively good result, compared to the developing sleeves of Comparison Experiments 1 to 3 prepared by a conventional surface roughening process, in which Example Experiments 1 to 5 has Criteria A, and Comparison Experiments 4 to 8 has Criteria B.

Further, in Example Experiments 1 to 5, the electromagnetic coil was applied with a frequency of 200 Hz or greater. In such Example Experiments 1 to 5, the depressions 139 having elliptical shape formed on the external surface of the developing sleeve 132 had a greater number of the second depressions 139*b*, extending or aligning in the circumferential direction of the developing sleeve 132 compared to the first depressions 139*a*, extending or aligning in the axial direction of the developing sleeve 132 (see "ratio of second depression" in Table 1). Such Example Experiments 1 to 5 show good results as shown in Table 1.

With such Example Experiments 1 to 5, it is confirmed that image concentration unevenness in a sheet transport direction can be suppressed or prevented when the number of the second depressions 139*b*, extending or aligning in the circumferential direction of the developing sleeve 132, is set greater than the number of the first depressions 139*a*, extending or aligning in the axial direction of the developing sleeve 132, on the external surface of the developing sleeve 132.

Further, another experiments were conducted to evaluate an effect of one shape factor of the depressions 139 formed on the external surface of the developing sleeve 132 to the image concentration unevenness in a sheet transport direction.

Specifically, the surface roughening process according to an exemplary embodiment was conducted in Example Experiments 1, 2, 3, 5, 7, and Comparison Experiment 11 by changing current values and frequency applied to the electromagnetic coil 8.

As illustrated in FIG. 18, the depression 139 formed on the external surface of the developing sleeve 132 has the deepest portion 200*c*, and the hypothetical first line L1 outwardly extends from the deepest portion 200*c* of the depression 139 in a radial direction of the developing sleeve 132, and the hypothetical second line L2 outwardly extends from the deepest portion 200*c* to the peripheral end portion 200*a* of the depression 139, wherein the peripheral end portion 200*a* is a rearward position of the depression 139 with respect to a direction of rotation of the developing sleeve 132, which is shown by an arrow. The hypothetical first and second lines L1 and L2 form the angle α.

By changing current values and frequency applied to the electromagnetic coil 8, developing sleeves having different angles α were prepared to evaluate image concentration unevenness in a sheet transport direction with the above-described sensory evaluation method. Table 1 also shows results of such experiments.

Example Experiment 7

The developing sleeve 132 was prepared as similar to Example Experiment 1. When such surface roughening process was conducted, the electromagnetic coil 8 was applied with power having a current value of 20 A and a frequency of 450 Hz, and such surface roughening process was conducted with a processing time of 30 sec and an amount of the magnetic abrasive grain 65 of 50 g. After that, the developing sleeve 132 was rotated at a rotation speed of 1480 rpm (revolution per minute) using a rotation machine, and a tape having a surface roughness of #400 was pressed on the surface of the developing sleeve 132 with a force of 10 kgf for a time of 10 sec to polish the surface of the developing sleeve 132. Such tape polishing was conducted to scrape the outer edge 200*a* of the depression 139 to reduce the hypothetical straight-line segment La.

Comparison Experiment 11

A developing sleeve was prepared as similar to Example Experiment 1. When such surface roughening process was conducted, the electromagnetic coil 8 was applied with power having a current value of 20 A and a frequency of 500 Hz, and such surface roughening process was conducted with a processing time of 30 sec and an amount of the magnetic abrasive grain 65 of 50 g. After that, the developing sleeve 132 was rotated at a rotation speed of 1480 rpm (revolution per minute) using a rotation machine, and a tape having a surface roughness of #400 was pressed on the surface of the developing sleeve 132 with a force of 10 kgf for a time of 15 sec to polish the surface of the developing sleeve 132. Such tape polishing was conducted to scrape the outer edge 200*a* of the depression 139 to reduce the hypothetical straight-line segment La.

With such prepared developing sleeves, image concentration unevenness in a sheet transport direction was evaluated with the above-described sensory evaluation method. Table 1 shows results of such experiments, wherein the angle α of the depression 139 is also shown. The angle α was measured by taking a plurality of depressions 139 as samples and then by averaging the angles of the sampled depressions 139.

Further, in order to confirm a relationship between the angle α and the image concentration unevenness, parameters other than the angle α (e.g., major axis length of elliptical shape, minor axis length of elliptical shape, depth of depression, a length of La and Lb) were set to similar values among the prepared developing sleeves by carefully conducting a surface treatment to the developing sleeves, by which such parameters may not cause some effect on the results.

As shown in Table 1, the developing sleeves 132 prepared in Example Experiments 1, 2, 3, 5, and 7 have little image concentration unevenness (i.e., Criteria A) in a sheet transport direction, which is a good result, compared to the developing sleeve prepared in Comparison Experiment 11 having Criteria B.

Accordingly, based on Example Experiments 1 to 5, it is confirmed that the depression 139 on the developing sleeve 132 has the angle α of less than 45 degrees (α<45 degrees) when the rotated magnetic field is set to a frequency of 200 Hz to 400 Hz. Further, although a length of "La−Lb (μm)" in Example Experiments 1, 3, 5, and 7 are smaller than a length of "La−Lb (μm)" in Comparison Experiment 11, it is confirmed that the Example Experiments 1, 3, 5, and 7 show good results (i.e., Criteria A) on image concentration due to a factor of the angle α. Based on such results, it is confirmed that the image concentration unevenness in a sheet transport direction can be suppressed or prevented when the depression 139 has the angle α of less than 45 degrees (α<45 degrees).

Further, another experiments were conducted to evaluate an effect of another shape factor of the depressions 139 formed on the external surface of the developing sleeve 132 to the image concentration unevenness in a sheet transport direction. Specifically, the surface roughening process according to an exemplary embodiment was conducted in Example Experiments 1 to 8 and Comparison Experiments 9 and 10 by changing current values and frequency applied to the electromagnetic coil 8. As illustrated in FIG. 18, the depression 139 may have the hypothetical straight-line segment La and the radius segment Lb. The hypothetical straight-line segment La extends from the rotation center P of the developing sleeve 132 to the peripheral end portion 200*a* of the depression 139. The radius segment Lb is one half of an outer diameter of the developing sleeve 132. By changing current values and frequency applied to the electromagnetic coil 8, developing sleeves having different values of "La−Lb" were prepared to evaluate image concentration unevenness in a sheet transport direction with the above-described sensory evaluation method. Table 1 also shows a result of such experiment.

Example Experiment 6

The developing sleeve 132 was prepared as similar to Example Experiment 1. When such surface roughening process was conducted, the electromagnetic coil 8 was applied with power having a current value of 20 A and a frequency of 450 Hz, and such surface roughening process was conducted with a processing time of 30 sec and an amount of the magnetic abrasive grain 65 of 50 g. After that, the developing sleeve 132 was rotated at a rotation speed of 1480 rpm (revolution per minute) using a rotation machine, and a tape having a surface roughness of #400 was pressed on the surface of the developing sleeve 132 with a force of 10 kgf for a time of 5 sec to polish the surface of the developing sleeve 132. Such tape polishing was conducted to scrape the outer edge 200*a* of the depression 139 to reduce the hypothetical straight-line segment La.

Example Experiment 8

The developing sleeve 132 was prepared as similar to Example Experiment 1. When such surface roughening process was conducted, the electromagnetic coil 8 was applied with power having a current value of 20 A and a frequency of 450 Hz, and such surface roughening process was conducted with a processing time of 30 sec and an amount of the magnetic abrasive grain 65 of 50 g. After that, the developing sleeve 132 was rotated at a rotation speed of 1480 rpm (revolution per minute) using a rotation machine, and a tape having a surface roughness of #400 was pressed on the surface of the developing sleeve 132 with a force of 10 kgf for a time of 20 sec to polish the surface of the developing sleeve 132. Such tape polishing was conducted to scrape the outer edge 200*a* of the depression 139 to reduce the hypothetical straight-line segment La.

Comparison Experiment 9

A developing sleeve was prepared as similar to Example Experiment 1. When such surface roughening process was conducted, the electromagnetic coil 8 was applied with power having a current value of 20 A and a frequency of 450 Hz, and such surface roughening process was conducted with a processing time of 30 sec and an amount of the magnetic abrasive grain 65 of 50 g.

Comparison Experiment 10

A developing sleeve was prepared as similar to Example Experiment 1. When such surface roughening process was conducted, the electromagnetic coil 8 was applied with power having a current value of 20 A and a frequency of 450 Hz, and such surface roughening process was conducted with a processing time of 30 sec and an amount of the magnetic abrasive grain 65 of 50 g. After that, the developing sleeve 132 was rotated at a rotation speed of 1480 rpm (revolution per minute) using a rotation machine, and a tape having a surface roughness of #400 was pressed on the surface of the developing sleeve 132 with a force of 10 kgf for a time of 23 sec to polish the surface of the developing sleeve 132. Such tape polishing was conducted to scrape the outer edge 200*a* of the depression 139 to reduce the hypothetical straight-line segment La.

With such prepared developing sleeves, image concentration unevenness in a sheet transport direction was evaluated with the above-described sensory evaluation method. Table 1 shows results of such experiment, wherein the length of "La−Lb" of the depression 139 are also shown. The length of "La−Lb" was measured by taking a plurality of depressions 139 as samples and then by averaging the length of the sampled depressions 139.

Further, in order to confirm a relationship between the length of "La−Lb" and the image concentration unevenness, parameters other than the "La−Lb" (e.g., major axis length of elliptical shape, minor axis length of elliptical shape, depth of depression, angles $\alpha$ and $\beta$) were set to similar values among the prepared developing sleeves by carefully conducting a surface treatment to the developing sleeves, by which such parameters may not cause some effect on the results.

As shown in Table 1, the developing sleeves 132 prepared in Example Experiments 1 to 8 have little image concentration unevenness (i.e., Criteria A) in a sheet transport direction, which is a good result, compared to the developing sleeves 132 prepared in Comparison Experiments 9 and 10 having Criteria B when 10,000 sheets were printed.

Accordingly, based on Example Experiments 1 to 5, it is confirmed that the depression 139 on the developing sleeve 132 has the hypothetical straight-line segment La greater than the radius segment Lb having a relationship of "20 μm≧La−Lb>5 μm" when the rotated magnetic field is set to a frequency of 200 Hz to 400 Hz.

Further, although the angle $\alpha$ in Example Experiments 6 to 8 are similar to the angle $\alpha$ in Comparison Experiments 9 and 10, it is confirmed that the Example Experiments 6 to 8 show good results on image concentration due to a factor of the "La−Lb." Based on such results, it is confirmed that the image concentration unevenness in a sheet transport direction can be suppressed or prevented when the depression 139 has the hypothetical straight-line segment La greater than the radius segment Lb having a relationship of "20 μm≧La−Lb>5 μm."

If "La−Lb" becomes too great (e.g., La−Lb>20 μm), an edge of the peripheral end portion 200*a*, provided at the rearward position of the depression 139, may more likely wear, abrade, or tear, by which an amount of developing agent carried on the external surface of the developing sleeve 132 may decrease over time.

A cross-sectional shape of concavities and convexities on the external surface of the developing sleeve 132 were measured with a laser focus displacement device "LT-8010" manufactured by KEYENCE CORPORATION at three points along one round of a developing sleeve. The measurement conditions include sampling number of 18000, sampling frequency of 1800 Hz, function of displacement, average measurement times of 2, measurement mode of normal, no darkout, no masking, no transparent member, and minimum light intensity of 130. With such conditions, the angle $\alpha$ and the length of "La−Lb" were computed.

As illustrated in FIGS. 10 and 11, the above-described image forming apparatus 101 includes the process cartridges 106Y, 106M, 106C, and 106K, and each of the process cartridges 106Y, 106M, 106C, and 106K includes the cartridge case 111, the charge roller 109, the photosensitive drum 108, the cleaning blade 112, and the development unit 113, for example. However, in an exemplary embodiment, the process cartridges 106Y, 106M, 106C, and 106K may not need to include all such sub-units or devices therein except the development unit 113. Accordingly, the cartridge case 111, the charge roller 109, the photosensitive drum 108, or the cleaning blade 112 may be omitted from the process cartridges 106Y, 106M, 106C, and 106K, for example. Further, although the image forming apparatus 101 may include the process cartridges 106Y, 106M, 106C, and 106K detachably mounted in the image forming apparatus 101, the process cartridges 106Y, 106M, 106C, and 106K can be omitted from the image forming apparatus 101. In such a case, the image forming apparatus 101 may include the development unit 113 as detachable unit, for example.

Further, in an exemplary embodiment, the outer diameter of the developing sleeve 132, the size of the magnetic abrasive grain 65, the outer diameter of the cylindrical member 50 of the container unit 9 can be changed to any values as required. Further, the surface shape of the developing sleeve 132 at its both end portion, a curvature radius and a shape size of magnetic abrasive grain 65 are preferably selected and determined based on several factors such as desired surface roughness, processing time (processing condition), number of reciprocating movement of the electromagnetic coil 8, durability of magnetic abrasive grain 65, or the like. Further, a total amount of the magnetic abrasive grain 65 contained in the container unit 9 may be preferably determined based on several factors such as desired surface roughness, processing time (processing condition), number of reciprocating movement of the electromagnetic coil 8, durability of magnetic abrasive grain 65, or the like.

Numerous additional modifications and variations are possible in light of the above teachings. It is therefore to be understood that within the scope of the appended claims, the disclosure of the present invention may be practiced otherwise than as specifically described herein. For example, elements and/or features of different examples and illustrative embodiments may be combined each other and/or substituted for each other within the scope of this disclosure and appended claims.

What is claimed is:

1. A magnetic particle carrying device, comprising:

a magnetic field generator configured to generate a magnetic field; and a hollow cylindrical structure configured to encase the magnetic field generator and to attract magnetic particles to an external surface of the hollow cylindrical structure using the magnetic field, the external surface of the hollow cylindrical structure having a plurality of elliptical depressions of two types formed therein, a long axis of a first type of elliptical depression extending in substantially an axial direction of the hollow cylindrical structure, a long axis of a second type of elliptical depression extending in substantially a circumferential direction of the hollow cylindrical structure, the external surface of the hollow cylindrical structure having more elliptical depressions of the second type than elliptical depressions of the first type.

2. The magnetic particle carrying device according to claim 1, wherein the depressions are randomly formed on the external surface of the hollow cylindrical structure.

3. The magnetic particle carrying device according to claim 1, wherein an angle $\alpha$ formed by a hypothetical line L1, extending outward in the radial direction of the hollow cylindrical structure from a bottom of each of the plurality of elliptical depressions, and a hypothetical line L2, extending outward from the bottom of each of the plurality of elliptical depressions to a rear edge of each of the plurality of elliptical depressions with respect to a direction of rotation of the hollow cylindrical structure, is less than 45 degrees.

4. The magnetic particle carrying device according to claim 3, wherein a hypothetical straight-line segment La extending from a rotation center of the hollow cylindrical structure to the rear edge of the depression and a radius segment Lb are such that $20\ \mu m \geqq La - Lb > 5\ \mu m$.

5. An image forming apparatus, comprising:

a latent image carrier configured to carry a latent image thereon;

a charger configured to charge a surface of the latent image carrier;

a writer configured to write the latent image on the latent image carrier; and a developing unit for developing the latent image with a developing agent, including:

a magnetic particle carrying device, including:

a magnetic field generator configured to generate a magnetic field; and a hollow cylindrical structure configured to encase the magnetic field generator and to attract magnetic particles to an external surface of the hollow cylindrical structure using the magnetic field, the external surface of the hollow cylindrical structure having a plurality of elliptical depressions of two types formed therein, a long axis of a first type of elliptical depression extending in substantially an axial direction of the hollow cylindrical structure, a long axis of a second type of elliptical depression extending in substantially a circumferential direction of the hollow cylindrical structure, the external surface of the hollow cylindrical structure having more elliptical depressions of the second type than elliptical depressions of the first type.

6. The image forming apparatus according to claim 5, wherein the developing agent includes toner particles and magnetic particles, and the magnetic particles have an average particle diameter of from 20 μm to 50 μm.

7. The image forming apparatus according to claim 5, wherein the developing unit is configured as a process cartridge that is detachably mountable in the image forming apparatus.

* * * * *